US008388126B2

(12) United States Patent
Chiwata

(10) Patent No.: US 8,388,126 B2
(45) Date of Patent: Mar. 5, 2013

(54) PRINTING PAPER SEASONING APPARATUS, METHOD OF SEASONING OF PRINTING PAPER, AND INKJET RECORDING APPARATUS

(75) Inventor: Yuhei Chiwata, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 281 days.

(21) Appl. No.: 12/974,685

(22) Filed: Dec. 21, 2010

(65) Prior Publication Data

US 2011/0181676 A1 Jul. 28, 2011

(30) Foreign Application Priority Data

Jan. 26, 2010 (JP) ..... 2010-014478

(51) Int. Cl.
*B41J 2/01* (2006.01)
*B41J 29/38* (2006.01)

(52) U.S. Cl. ..... 347/102; 347/16; 347/104; 34/414; 34/629

(58) Field of Classification Search ..... 347/102, 347/104, 101, 103; 271/3.07, 3.11, 90, 97, 271/145, 211; 34/414, 629
See application file for complete search history.

(56) References Cited

U.S. PATENT DOCUMENTS 1,725,764 A * 8/1929 Poggel ..... 34/621
3,737,051 A * 6/1973 Horino ..... 414/788
8,297,748 B2 * 10/2012 Chiwata ..... 347/102
2011/0219641 A1 * 9/2011 Fujikura et al. ..... 34/619

FOREIGN PATENT DOCUMENTS

JP 8-175690 A 7/1996
JP 10-297813 A 11/1998
JP 2008-290800 A 12/2008

* cited by examiner

*Primary Examiner* — Manish S Shah
*Assistant Examiner* — Jeffrey C Morgan
(74) *Attorney, Agent, or Firm* — Birch, Stewart, Kolasch & Birch, LLP

(57) ABSTRACT

A printing paper seasoning apparatus includes: a loading table on which a plurality of sheets of printing paper are stacked and loaded; a ceiling plate which is disposed above the loading table so as to oppose the loading table for covering over an upper side of a stack of the printing paper loaded on the loading table; an air blowing device which blows air from a side face side into a paper accommodating region formed between the loading table and the ceiling plate which are arranged so as to oppose each other; a side plate arranged in a side face portion of the paper accommodating region; and an exhaust section including openings formed in the side plate, wherein an opening ratio of the exhaust section varies in a vertical direction of the paper accommodating region in such a manner that the opening ratio on a lower side of the exhaust section is smaller than the opening ratio on an upper side of the exhaust section.

10 Claims, 22 Drawing Sheets

AIR FLOW VOLUME PER UNIT LENGTH OF PAPER AND SEASONING TIME

PRINTING PAPER SEASONING APPARATUS, METHOD OF SEASONING OF PRINTING PAPER, AND INKJET RECORDING APPARATUS

FIELD OF THE INVENTION

The present invention relates to a printing paper seasoning apparatus, a printing paper seasoning method and an inkjet recording apparatus, and more particularly, to seasoning technology which adapts paper after printing to ambient temperature and ambient humidity, and reduce expansion/contraction deformation of the paper.

DESCRIPTION OF THE RELATED ART

Immediately after ink has been deposited on paper by a printing apparatus, expansion and contraction of the paper occurs due to the difference in moisture content resulting from the light and dark tones (different ink volumes) of the ink in the image region. This is especially pronounced in a system which performs printing onto normal paper using water-based ink. Furthermore, when carrying out double-side printing, normally, after completing printing on one side (the front surface), printing is carried out on the opposite surface (the rear surface), but immediately after printing on the front surface, there is significant expansion/contraction of the paper and deviation occurs in the size and position of the images printed respectively on the front surface and the rear surface (there is mismatch between the front and rear positional registration).

Furthermore, in the case of single-side printing also, and not only double-side printing, deterioration of printing quality occurs due to the occurrence of curl or cockling as a result of deformation of the paper as described above, and in addition to this, adverse effects are caused on subsequent processing steps, such as a binding process, which are carried out after the printing step.

An air blowing apparatus which blows an air flow between the sheets is disclosed in Japanese Patent Application Publication No. 2008-290800, Japanese Patent Application Publication No. 08-175690 and Japanese Patent Application Publication No. 10-297813. Japanese Patent Application Publication No. 2008-290800 discloses a composition in which air blowing is performed on the end surface of a stack of paper from a direction of one edge of the paper in a state where the front and rear sides of the stack of paper are held by a pair of pressing members. Japanese Patent Application Publication No. 2008-290800 relates to a paper handling apparatus and proposes technology for improving paper handling by imparting an inclined shape to a pressing member in such a manner that a gap is formed between the pressing member and paper.

Japanese Patent Application Publication No. 08-175690 proposes a composition in which an air nozzle is disposed movably in the vertical direction at an end side of stacked printing paper, and the paper is handled by blowing pressurized air from the air nozzle. Furthermore, Japanese Patent Application Publication No. 08-175690 also discloses a composition in which, in order to prevent displacement of the paper at the end of air blowing, the upper surface of the stacking paper is pressed with a pressing clamp at the end of air to blowing.

In Japanese Patent Application Publication No. 10-297813, outer perimeter walls are provided at the four outer perimeter faces of stacked paper, and an air blowing port is provided in at least one outer perimeter walls, whereby dispersion of air from the air blowing port to the exterior of the stacked paper is prevented, and the air can be introduced efficiently into the plurality of sheets of printing paper. Furthermore, at the end of air blowing, the air is suctioned from between the sheets of paper and the paper is stacked in an orderly manner while suppressing the floppy paper.

However, the apparatuses described in Japanese Patent Application Publication No. 2008-290800, Japanese Patent Application Publication No. 08-175690 and Japanese Patent Application Publication No. 10-297813 provide technology aimed at reducing frictional force between sheets of paper by introducing air between the sheets (to separate paper), and are not capable of sufficiently carrying out paper seasoning to adapt paper after printing rapidly to the ambient humidity.

There is a possibility that in achieving an apparatus capable of collecting together a stack of paper after printing (printed matter) and seasoning the paper uniformly in a short period of time, if the paper has a heavy weight or large thickness, then air cannot be readily introduced between the sheets due to the weight of the paper (influence of gravity), and seasoning performance becomes poor. Furthermore, depending on the image contents, the volume of ink and the properties of the paper, paper curl after printing is also large, and in this case the lie of the paper is disrupted, passage of a uniform air flow between the sheets becomes more difficult, and the seasoning characteristics become worse.

SUMMARY OF THE INVENTION

The present invention has been contrived with the foregoing circumstances in view, an object thereof being to provide a printing paper seasoning apparatus and a printing paper seasoning method, and an inkjet recording apparatus employing same, whereby a stack of paper can be seasoned uniformly in a short period of time.

The following modes of the invention are offered in order to achieve the aforementioned object.

In order to attain an object described above, one aspect of the present invention is directed to a printing paper seasoning apparatus comprising: a loading table on which a to plurality of sheets of printing paper are stacked and loaded; a ceiling plate which is disposed above the loading table so as to oppose the loading table for covering over an upper side of a stack of the printing paper loaded on the loading table; an air blowing device which blows air from a side face side into a paper accommodating region formed between the loading table and the ceiling plate which are arranged so as to oppose each other; a side plate arranged in a side face portion of the paper accommodating region; and an exhaust section including openings formed in the side plate, wherein an opening ratio of the exhaust section varies in a vertical direction of the paper accommodating region in such a manner that the opening ratio on a lower side of the exhaust section is smaller than the opening ratio on an upper side of the exhaust section.

According to this aspect of the invention, it is possible to increase the air pressure on the lower side, compared with the air pressure on the upper side, of the paper accommodating region during air blowing, and it is possible to improve the passage of air between sheets of paper by ensuring a sufficient gap between the sheets of paper. Furthermore, the attitude of the paper during air blowing is stabilized and folding of the paper and damaging of the image can be prevented.

The opening ratio of the exhaust section may become smaller, in stepwise fashion or continuously, from an upper side toward a lower side of the paper accommodating region.

The mode of varying the opening ratio of the exhaust section is not limited to a two-stage switching mode in which the opening ratio on the upper side and the opening ratio on the lower side are different from each other, but rather it is also possible to adopt a mode where the opening ratio is switched in steps, between 3 stages, 4 stages, . . . , or N stages (where N is an integer equal to or greater than 2), in accordance with the height. In this case, the amount of change (change rate) of the opening ratio (the step width) may be constant or may be varied as appropriate. Furthermore, if the exhaust section is divided into N stages in the vertical direction, the width (length in the vertical direction) of each divided region may be set by dividing the vertical height into equal divisions, or by dividing it into non-equal divisions.

A minimum value of the opening ratio on the lower side may be 1/20 or more and 2/3 or less of a maximum value of the opening ratio on the upper side.

The greater the difference between the opening ratio on the lower side and the opening ratio on the upper side, the greater the air pressure difference between the upper side and lower side during air blowing. The suitable conditions for the pressure distribution vary to with the number of sheets in the stack of paper, and the like, but the conditions according to this mode are desirable in achieving a balance between the opening ration on the upper and lower sides. According to this mode, it is possible generally to achieve good air passage characteristics.

The exhaust section may be formed in, of the side plates which cover the side face portions of the paper accommodating region, the side plate where the air blowing device is not provided.

For example, if air blowing is performed from the end face direction on one edge of rectangular paper (one direction), then an exhaust section is formed at least in the side plate of the edge on the side opposite to that edge (the edge where the air blowing device is provided). Alternatively, if confronting air flows are blown from end face directions of two mutually opposing edges of rectangular paper (two directions), then an exhaust section is formed in the side plates of the two edges which are perpendicular to the edge where the air blowing device is provided.

A paper loading surface of the loading table and a paper restricting surface of the ceiling surface which opposes the paper loading surface may have curvature in a direction perpendicular to an air blowing direction of the air blowing device.

According to this mode, by accommodating paper between a paper loading surface and a paper restricting surface that have curvature, a paper stack is forcibly curved due to the shape of the paper loading surface and the paper restricting surface. By adopting a composition in which an air flow is blown from an end face direction of an edge of paper which is curved in this way, it is possible to improve the passage of air between the sheets of paper and good seasoning can be achieved, even if there is paper having strong curl.

Desirably, Static pressure of the air blown from the air blowing device is 500 (Pa) or more.

More desirably, it is possible to simultaneously satisfy both of the following conditions: that the air flow volume q passing per sheet and per unit length of the breadthways direction of the paper viewed from the air blowing side of the air blowing device satisfies $q>0.02$ ($m^2$/min), and that the static pressure P of the air blown from the air blowing device satisfies $P>500$ (Pa).

By blowing air under these conditions, it is possible to pass air between sheets of paper while overcoming pressure loss between the sheets.

From the viewpoint of adapting the paper after printing rapidly and uniformly to the humidity of the surrounding environment, desirably, the air blowing device blows air of the same temperature and humidity as the surrounding environment (for example, an air blower which directly blows the surrounding air is desirable).

A desirable mode is one where a plurality of air blowers are used as the air blowing device, and desirably, the air blowing output of the plurality of air blowers is controllable. Furthermore, it is also possible to achieve a more suitable air flow volume distribution and pressure distribution in accordance with the characteristics of the opening ratio of the exhaust section, by arranging two or more air blowers in the vertical direction of the paper accommodating region and controlling the output of these air blowers (for example, making the air blowing intensity on the lower side stronger than on the upper side).

Desirably, air volume vs. static pressure characteristics of the air blowing device encompass a point where required air flow volume $Q=M\times Wp\times 0.02$ ($m^3$/min) and required static pressure $P=500$ (Pa), where M (sheets) represents a maximum number of processed sheets which can be processed simultaneously in one lump by the seasoning apparatus and Wp (m) represents length of one edge of a breadthways direction of the paper viewed from an air blowing side of the air blowing device.

It is possible to calculate the required air flow volume Q from the maximum number M of processed sheets which can be accommodated in the loading table and the size of the paper (Wp). It is possible to judge whether or not appropriate seasoning is possible by means of an air blowing device, from the positional relationship between a graph of the air flow volume/static pressure characteristics of the air blowing device and a point representing the required air flow volume $Q=M\times Wp\times 0.02$ ($m^3$/min) and the required static pressure $P=500$ (Pa).

For example, when a graph of the characteristics of the air blowing device is plotted on a coordinates system where the horizontal axis represents the air flow volume (increasing toward the right-hand side) and the vertical axis represents the static pressure (increasing in the upward direction), then if the point which represents the required air flow volume of $Q=M\times Wp\times 0.02$ ($m^3$/min) and the required static pressure $P=500$ (Pa) lies on this characteristics graph or is situated in the region below this characteristics graph, then air blowing which satisfies required air blowing conditions can be achieved by the air blowing device. Desirably, an air blowing device which satisfies these conditions is employed.

The printing paper seasoning apparatus may comprise at least one shelf plate and having composition in which the printing paper is accommodated by being divided into a plurality of stacks by a structure of a plurality of tiers divided by the at least one shelf plate.

When the number of stacked sheets becomes greater, it becomes more difficult for the air flow to pass by the sheets of paper in the lower positions, due to the effects of gravity (the weight of the paper). In order to resolve this problem, it is possible to employ a composition in which, when a plurality of sheets of paper are accommodated on the table, the paper is divided and accommodated in a suitable number of stacks, by means of shelf plate members. By dividing the paper accommodating space by means of shelf plate members and thus creating a plurality of stages in the paper accommodating section, the weight of the paper stack divided into respective stages is supported by the respective shelf plate members and the table. By this means, the load of the paper weight is distributed and an air flow can be passed sufficiently through the paper stacked in lower positions.

In the case of a composition where the paper sheets are divided and accommodated by shelf plate members in this way, a desirable mode is one where air blowing units (air blowing devices) are provided respectively for the paper accommodating range of each stage.

The seasoning apparatuses described above may be constituted as a separate apparatus from a printing apparatus, or may be combined with the printing apparatus and incorporated as a portion of a printing system.

In order to attain an object described above, another aspect of the present invention is directed to an inkjet recording apparatus comprising any one of the printing paper seasoning apparatuses described above installed in a paper output section.

Printed matters recorded by an inkjet method have a high water content compared to printed matters produced by other printing methods, and problems due to deformation of the paper are pronounced, and therefore it is beneficial to carry out seasoning by using a seasoning apparatus according to the present invention in respect of printed matters printed by an inkjet recording apparatus.

In order to attain an object described above, another aspect of the present invention is directed to a method of seasoning of printing paper, comprising the steps of: loading a plurality of sheets of the printing paper onto a loading table; covering over an upper side of a stack of the printing paper loaded on the loading table, with a ceiling plate; and blowing air by an air blowing device from a side face side into a paper accommodating region formed to between the loading table and the ceiling plate which are arranged to oppose each other, so as to supply the air between sheets of the printing paper in the stack of the printing paper, wherein openings for expelling air are formed on a side plate arranged in a side face portion of the paper accommodating region, an opening ratio of an exhaust section including the openings is varied in a vertical direction of the paper accommodating region in such manner that the opening ratio on a lower side is made smaller than the opening ratio on an upper side, and the air blown by the air blowing device in a state where pressure of air flowing on a lower side of the paper accommodating region is higher than pressure of air flowing on an upper side of the paper accommodating region.

According to the present invention, it is possible to make the air pressure on the lower side during air blowing higher than on the upper side, by making the opening ratio of the exhaust section lower on the lower side, and therefore it is possible to guarantee sufficient gaps between the sheets of paper on the lower side. By this means, it is possible to achieve uniform seasoning.

According to the present invention, it is possible to prevent expansion/contraction and deformation of the paper after printing, and it is also possible to improve productivity of printed objects. Furthermore, according to the present invention, it is possible to prevent registration displacement between front and rear surfaces when carrying out double-side printing, and suitability for subsequent processes, such as a binding process, is also improved.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

First Embodiment; Example of Composition of Seasoning Apparatus

Figure 1:
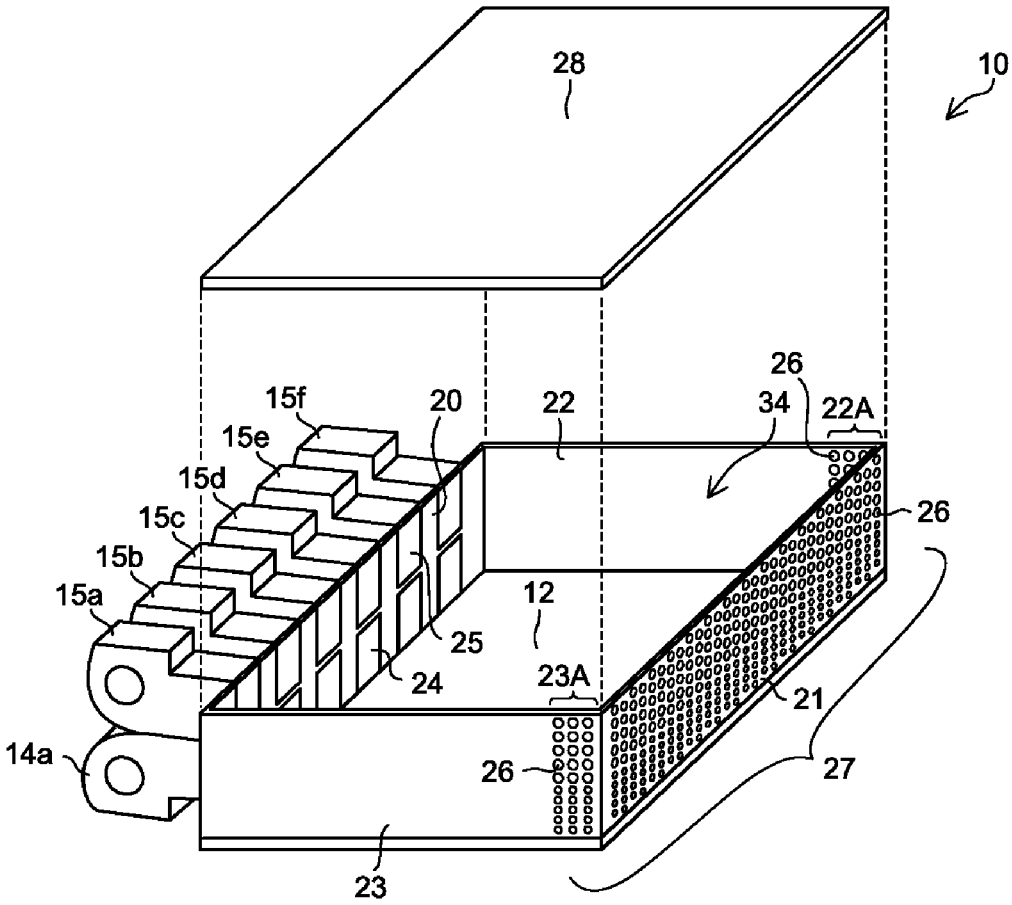
FIG. 1 is a perspective diagram of a seasoning apparatus relating to a first embodiment of the present invention.

FIG. 1 is a perspective diagram of a seasoning apparatus relating to a first embodiment of the present invention. As shown in FIG. 1, the seasoning apparatus 10 according to the present example includes a loading table 12 on which a plurality of sheets of printing paper (which are not shown in FIG. 1, but represented by reference numeral 30 in FIGS. 4A and 4B, FIG. 8 and FIG. 16; and may be referred to simply as "paper" below) can be loaded, and blowers 14*a* and 15*a* to 15*f* which blow an air flow from an outer perimeter face of the stack of paper loaded on the loading table 12. In FIG. 1, lower-tier blowers 14*b* to 14*f* are not visible, but blowers 14*b* to 14*f* are arranged respectively below the upper-tier blowers 15*b* to 15*f*, in a similar positional relationship to that of the blower 14*a* which is arranged below the blower 15*a*.

In order to simply the description below, the lower stage blowers 14*a* to 14*f* are represented by the reference numeral 14, and the upper stage blowers 15*a* to 15*f* are represented by the reference numeral 15. In FIG. 1, a centrifugal blower is depicted, but there are no particular restrictions on the air blowing method, and it is also possible to use an axial flow blower.

The seasoning apparatus 10 according to the present embodiment has a composition whereby air is blown toward a stack of paper from the end face side on one side which corresponds to a long edge of rectangular cut sheet paper, and the plurality of blowers 14 and 15 are arranged in two stages, upper and lower stages, facing the long edge of the paper. In the lower part of the left-hand side of FIG. 1, the blowers 14*a* to 14*f* are arranged at substantially equidistant intervals in the long edge direction of the paper, and the upper-stage blowers 15*a* to 15*f* are similarly arranged at substantially equidistant intervals, near to and above the blowers 14*a* to 14*f* respectively.

By arranging the blowers 14 and 15 in two stages, namely, an upper stage and a lower stage, in this way, it is possible to create an air flow cross-sectional area capable of supplying to air to between all of the sheets simultaneously, as well as being able to control the distribution of the air flow volume in the direction of stacking of the paper 30 (in other words, in the vertical direction). Furthermore, by arranging a plurality of blowers 14*a* to 14*f* and 15*a* to 15*f* at substantially equidistant intervals in the breadthways direction of the paper (horizontal direction), it is possible to improve (optimize) the distribution of the air flow volume in the breadthways direction of the paper.

Furthermore, in the seasoning apparatus 10, side plates 20, 21, 22 and 23 are erected at the four outer perimeter faces of the placing table 12, in order to restrict the position of paper on the placing table 12 and improve the efficiency of the air flow. Openings or slits corresponding to the air blowing ports 24, 25 are formed in the side plate 20 on the face where the blowers 14 and 15 are arranged, at the positions of the air blowing ports of the respective blowers 14 and 15.

The air blowing ports 24 and 25 are formed with an opening length substantially equal to the height of the paper accommodating range in the paper stacking direction in such a manner that an air flow is blown simultaneously throughout substantially the whole range of the height direction of the paper accommodating section which is defined by the placing table 12 and the ceiling plate 28. By adopting a composition of this kind, it is possible to direct an air flow simultaneously onto all of the sheets of paper (the whole paper stack) placed on the placing table 12.

In this way, by adopting a composition which restricts the range of the air blowing outlets and closes off the peripheral area of the respective air blowing ports 24 and 25 with a wall member (side plate 20), the direction of travel of the air flow blowing from the blowers 14 and 15 is restricted and leaking of air is prevented. By this means, it is possible to introduce the air flow generated by the blowers 14 and 15 efficiently into a paper accommodating section 34 (corresponding to a "paper accommodating region") on the placing table 12, and a strong air flow can be directed onto the stack of paper placed on the placing table 12.

Openings 26 for the air flow to escape (evacuation of air) are formed in side plates 21, 22, 23 which are erected at the edges of the outer perimeter surfaces of the loading table 12 where the blowers 14 and 15 are not disposed. More specifically, a lot of openings 26 are formed throughout substantially the whole range of the side plate 21 which faces the side plate 20 where the blowers 14 and 15 are disposed (the side plate 21 being erected on an edge to corresponding to a long edge of the paper). Furthermore, in the left and right-hand side plates 22 and 23 (the side plates erected at the edges corresponding to the short edges of the paper) which are positioned between the side plates 20 and 21 on the long edges, the openings 26 are formed only in partial regions 22A and 23A which are adjacent to the side plate 21.

An "exhaust section" is constituted by the portions of the side plates 21, 22, 23 where the plurality of openings 26 are formed (exhaust opening formation section). The exhaust section is indicated by the reference numeral 27 below. It is possible to introduce an air flow efficiently by restricting the air blowing ports 24 and 25 through which air is introduced into the paper accommodating space 34, and the exhaust section 27 through which air exits the space.

As described in detail below, in the exhaust section 27 in the present embodiment, the opening ratio on the side near the loading table 12 (the lower side) is lower than the opening ratio on the side near the ceiling plate 28 (the upper side) (see FIG. 10 to FIG. 13).

The number and specifications of the blowers 14 and 15 which constitute the air blowing devices, and the size, shape and other features of the air blowing ports 24 and 25 are designed appropriately by taking account of the size, material, thickness, quantity, etc., of the paper, so as to obtain the air flow volume and pressure required in order to satisfy the prescribed air blowing conditions. Furthermore, the height dimension of the side plates 20, 21, 22 and 23 is designed appropriately in accordance with the maximum load capacity of paper which can be set on the placing table 12.

When seasoning is carried out, the stack of paper after printing is placed on the placing table 12, and is covered from above with the ceiling plate 28. The ceiling plate 28 is arranged substantially in parallel with the face of the placing table 12, and serves to prevent the paper 30 from flying upward during air blowing. The ceiling plate 28 may be fixed at a prescribed height position, for instance, so as to contact the upper end faces of the side plates 20 to 23 and thereby close off the ceiling face of the paper accommodating section 34, or may adopt a composition whereby the height position of the ceiling plate 28 can be adjusted appropriately in accordance with the number of sheets of paper 30.

For instance, the ceiling plate 28 is composed movably in the stacking direction of the paper 30, by means of a position adjusting device comprising a movement mechanism which is not illustrated. Consequently, the height position of the ceiling plate 28 is adjusted in accordance with the number of sheets of paper 30 disposed on the placing table 12, thereby to forming the paper accommodating section 34 having a suitable width corresponding to the number of sheets for processing.

Moreover, the ceiling plate 28 may be composed so as to be raised at the start of air blowing. By starting the blowing of air from the blowers 14 and 15, air is supplied between the sheets of paper 30 on the placing table 12, thereby forming suitable gaps between the sheets of paper 30, and therefore the height position of each sheet of paper rises with the air blowing action. Consequently, the height position of the uppermost sheet of paper rises up compared to when no air is being blown. Hence, a desirable composition is one where the ceiling plate 28 is raised up in accordance with the amount of floating up of the paper during the blowing of air. By adopting this composition, it is possible to ensure a gap having a suitable interval between the sheets of paper, as well as being able to suppress flapping of the paper due to air blowing, and damage to the printed matter as a result of contact between the paper 30 and the ceiling plate 28 can be avoided.

Mode of Air Blowing Device

Since a chief aim of the seasoning apparatus 10 according to the present embodiment is to uniformize the water content in the paper (adjust to the ambient temperature and humidity) after printing where ink has been deposited on at least one side of the paper, it is desirable that the air blowing devices blow the peripheral air (namely, a flow of air having the temperature and humidity of the surrounding environment) with a view to preventing excessive drying. Supposing that a device is employed which blows an air flow of low humidity, such as air heated by a heater or the like (warm air flow), compressed air, dry air, or the like, then the remaining amount of water in the paper becomes lower than the ambient saturation point, and shrinkage of the paper occurs. For example, if a low-humidity air flow is used, then although it is possible to carry out drying in a short period of time in regions where a large amount of ink has been deposited onto the paper, an excessively dried state occurs in areas of the paper where no ink has been deposited or regions where the amount of ink is extremely small. There is a possibility that the resulting difference in the amount of water may produce expansion and contraction (deformation) of the paper.

In this respect, the air blowing devices according to the present embodiment are composed so as to blow air having the temperature and humidity of the surrounding environment by means of air blowers (the blowers 14 and 15), and are not provided with any device for controlling and adjusting the temperature and humidity, such as a heating device or to dehumidifying device. By adopting this composition, it is possible to adjust the paper after printing to the ambient temperature and humidity, and it is also possible to suppress deformation caused by expansion and contraction of the paper.

Figure 2:
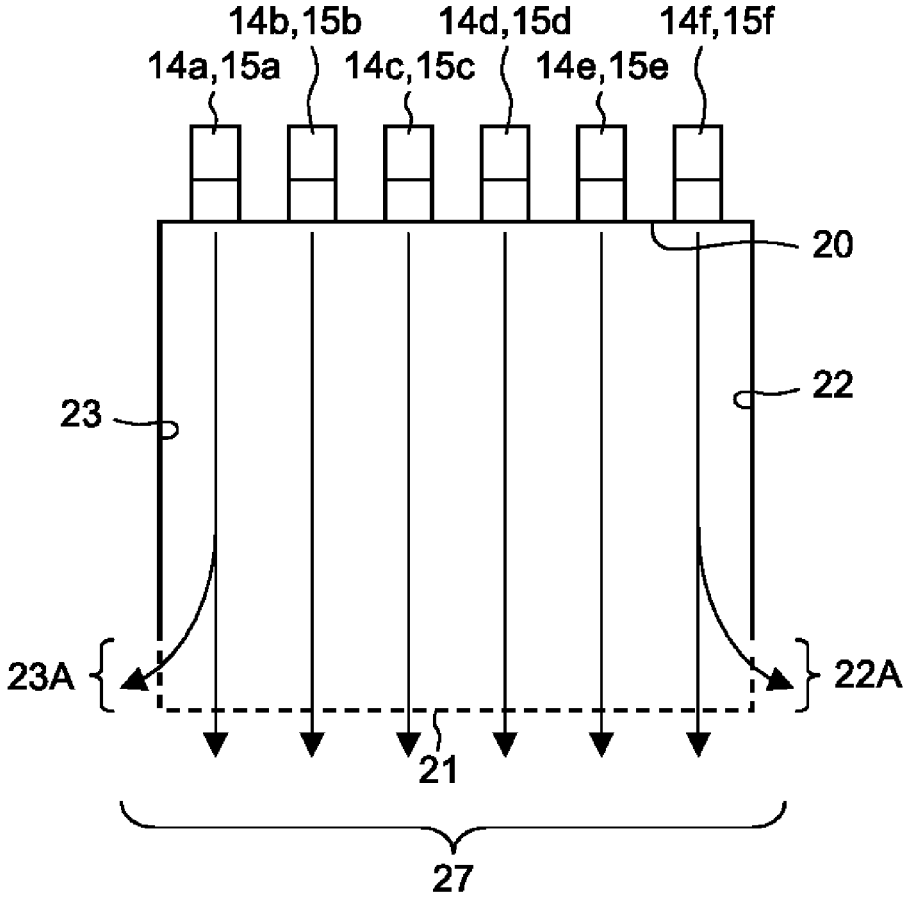
FIG. 2 is a plan diagram showing a schematic view of a flow of air inside the seasoning apparatus relating to the first embodiment.

FIG. 2 is a plan diagram showing a schematic view of a state during air blowing. The arrows in FIG. 2 give an approximate indication of the flow of air. As shown in FIG. 2, by introducing an air flow simultaneously from a group of blowers which are arranged in the direction of the long edge of the paper, and by creating forced turbulence of the air and then causing the air to exit from the exhaust section 27, a composition is achieved in which sufficient air is supplied between the sheets of paper, while maintaining the paper in a stable attitude.

With regard to the control of the air flow volume between the columns of blowers which are arranged in six positions in the lateral direction, following the direction of the longer edge of the paper, it is possible to adopt a mode where the air flow volume in each row is equal or a mode where the air flow volume is varied between the rows. For example, it is possible to create a desired air flow volume distribution in the horizontal direction by controlling the air flow balance in the blower columns, for instance, by making the air flow volume in the central blower columns (the column 14*c*, 15*c*, and the column 14*d*, 15*d*) relatively larger than the air flow volume in the blower columns at either end (the column 14*a*, 15*a*, and the column 14*f*, 15*f*). The magnitude of the air flow volume corresponds to stronger or weaker air blowing intensity, and hence the distribution of the air flow volume can be interpreted as the distribution of the air blowing intensity.

In the foregoing description, a group of blowers are arranged along a long edge of the paper, but in implementing embodiments of the present invention, it is also possible to adopt a mode in which a blower group is arranged along a short edge of the paper.

Second Embodiment

Figure 3:
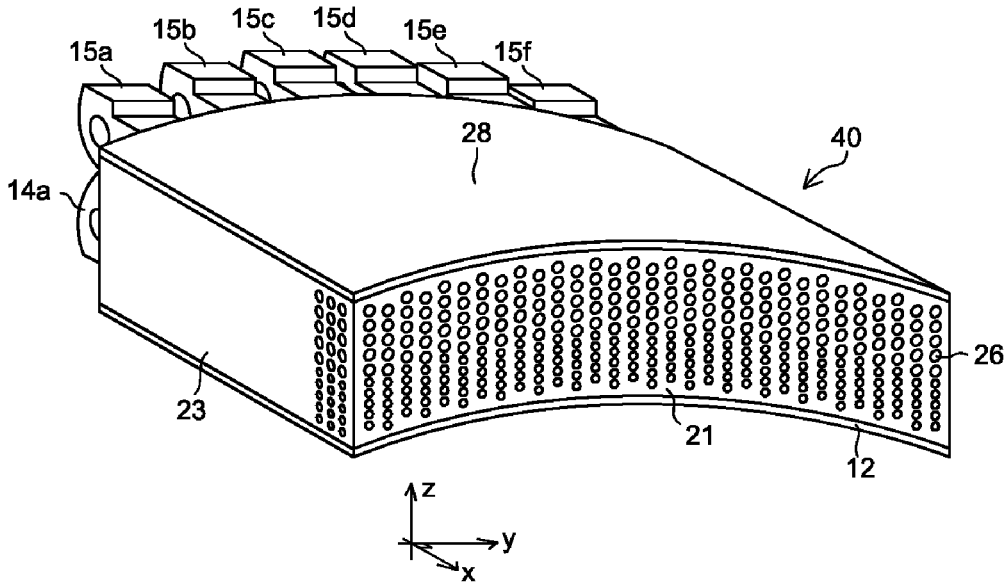
FIG. 3 is a perspective diagram of a seasoning apparatus relating to a second embodiment of the present invention.

FIG. 3 is a perspective diagram showing a principal part of a seasoning apparatus 40 relating to a second embodiment. The difference with respect to the first embodiment described in relation to FIG. 1 lies in the fact that the loading table 12 and the ceiling plate 28 have a curved shape. In FIG. 3, elements which are the same as or similar to the example shown in FIG. 1 are labeled with the same reference numerals and further explanation thereof is omitted here.

In the seasoning apparatus 40 shown in FIG. 3, the loading surface of the loading table 12 (the surface on which paper is placed, hereinafter also called the "paper loading surface") is curved in an upwardly convex arch shape. The lower surface of the ceiling plate 20 (the surface which opposes the table surface of the loading table 12, hereinafter also called "paper restricting surface") is also formed in an arch shape which is curved in the same direction as the arch shape of the paper loading surface (the paper restricting surface forms a concave curved surface).

If the air blowing direction of the blowers 14 and 15 (the direction parallel to the short edges of the paper) is taken to be the "x direction", and the direction perpendicular to this (the direction parallel to the long edges of the paper) is taken to be the "y direction", then the paper loading surface of the loading table 12 and the paper restricting surface of the ceiling plate 28 in the seasoning apparatus 40 shown in FIG. 3 have a curvature in the y direction (and no curvature in the x direction).

As shown in the drawing, the paper loading surface and the paper restricting surface according to the present embodiment are both formed so as to curve upward in the vertical direction (the z direction in FIG. 3). In FIG. 3, the paper accommodating space 34 is formed as a substantially bow-shaped space bordered on either side (sandwiched) by a plurality of curved surfaces (the paper loading surface and the paper restricting surface) which are both curved in a convex shape in the same direction (z direction). As shown in FIG. 3, due to the paper accommodating space 34 demarcated by the loading table 12 and the ceiling plate 28 which have this curved shape, the paper inside the paper accommodating space 34 is forcibly curved along the curved shapes and the attitude of the paper is restricted.

Direction of Curve of Paper

Figure 4A:
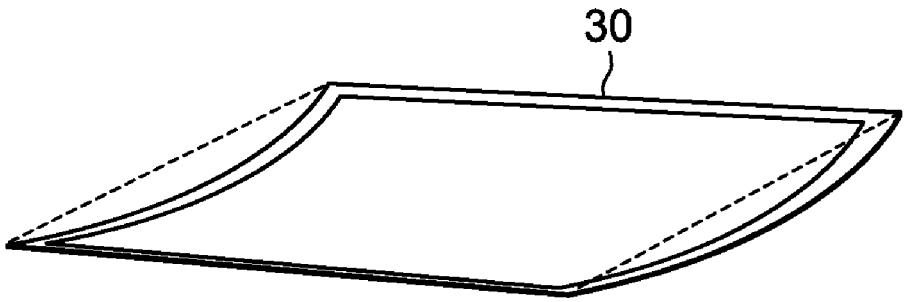
FIGS. 4A and 4B are illustrative diagrams showing a direction of curvature of paper.
Figure 4B:
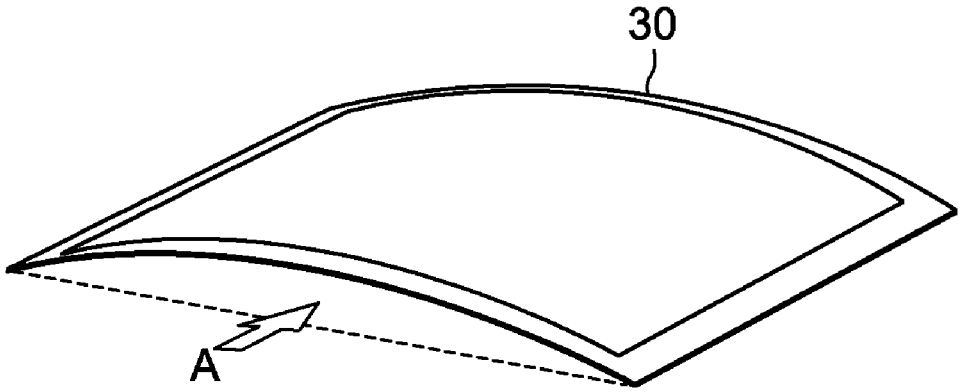

FIG. 4A shows an example of the state of curl of paper after printing. As shown in FIG. 4A, it is supposed that curl has occurred in the short edge direction of the paper 30 after printing (this is called "initial curl"). In the seasoning apparatus 40, the shape of the paper accommodating space 34 is composed in such a manner that, when the paper is seasoned in the seasoning apparatus 40, the paper 30 is caused to bend in the direction perpendicular to the direction of the initial curl (the long edge direction of the paper), as shown in FIG. 4B. In this way, the attitude (state of curl) of the paper 30 is restricted, and air blowing is performed from a direction substantially perpendicular to the edges of the curved paper 30 (the arch-shaped to edges), (in other word, from the direction of the white arrow A in FIG. 4B.)

The curvature $1/r_1$ (where $r_1$ is the radius of curvature) of the paper loading surface in the seasoning apparatus 40 shown in FIG. 3 is substantially the same through the length of the paper in the x direction (the air blowing direction). Furthermore, the curvature $1/r_2$ (where $r_2$ is the radius of curvature) of the paper restricting surface in the seasoning apparatus 40 is substantially the same through the length of the paper in the x direction (the air blowing direction). The radius of curvature, $r_1$, of the paper loading surface and the radius of curvature, $r_2$, of the paper restricting surface do not necessary have to be matching, but desirably have approximately the same value.

The amount of curvature is designed appropriately in accordance with the size and thickness of the paper, the upper limits of the paper stack, and so on. For example, if the width w of the long edges of the paper stack loading table is set to approximately 600 mm, the projecting height H of the paper loading surface is approximately 50 to 60 mm.

Figure 5:
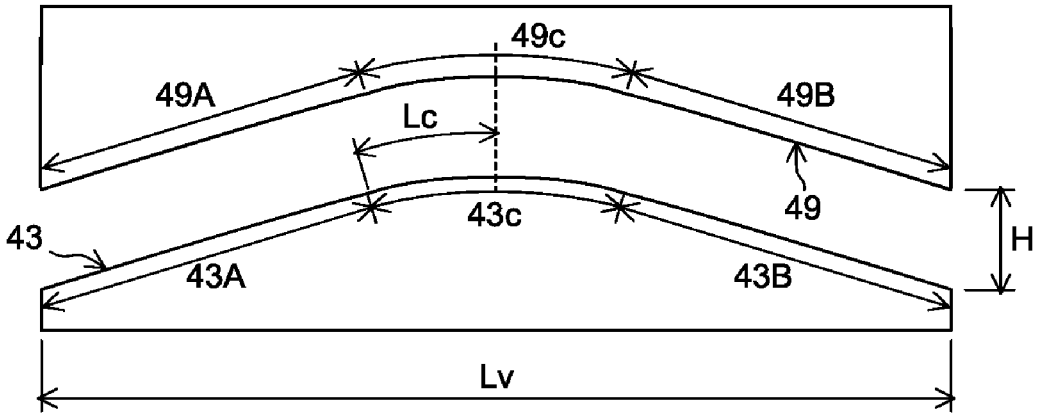
FIG. 5 is a diagram showing an example of a paper loading surface and a paper to restricting surface which are attained by combining flat sections and a curved section.

The curved surface of the paper loading surface does not necessarily have to be a circular arc shape (a circular cylindrical surface shape), and as shown in FIG. 5, the paper loading surface 43 may be a combination of flat sections (linear sections) 43A, 43B and a circular cylindrical surface section (a circular arc-shaped curved section) 43C. The portion which faces the center of the paper is the upwardly convex curved section 43C, and the portions which face the end portions of the paper on either side of this curved section 43C are the flat sections 43A and 43B. Similarly to the paper restricting surface 49, it is also possible to combine flat sections (linear sections) 49A and 49B, and a circular cylindrical surface section (a circular arc-shaped curved section) 49C.

The respective dimensions in FIG. 5 are as follows, for example.

Ly: 627.1±0.5 mm

Lc: 11.1°

Lp: 197.2 mm

H: 50.8 mm

Radius of curvature $r_1=r_2=62.1$ mm

The dimensions given above are examples, and in implementing the present invention, various design modes are possible.

Third Embodiment

Figure 6:
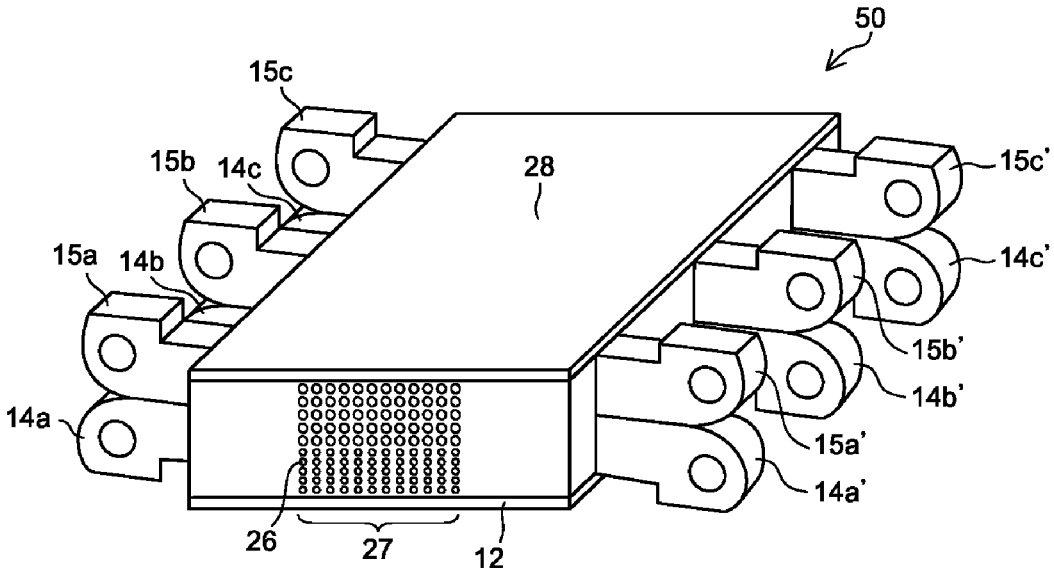
FIG. 6 is a perspective diagram of a seasoning apparatus relating to a third embodiment of the present invention.

FIG. 6 is a perspective diagram showing a principal part of a seasoning apparatus 50 to relating to a third embodiment. In FIG. 6, elements which are the same as or similar to the example shown in FIG. 1 are labeled with the same reference numerals and further explanation thereof is omitted here. The seasoning apparatus 50 shown in FIG. 6 has a composition which blows air toward a stack of paper from the end faces of the two edges corresponding to the long edges of rectangular cut sheet paper, and a plurality of blowers 14, 15 are arranged in two tiers, an upper and lower tier, at three positions facing the long edges of the paper. The blowers 14*a* to 14*c* are arranged at substantially equidistant intervals in the long edge direction of the paper in the lower tier on the left-hand side in FIG. 6, and the blowers 15*a* to 15*c* in the upper tier are similarly arranged at substantially equidistant intervals in the vicinity of the upper portion of the blowers 14*a* to 14*c*.

The blower arrangement on the right-hand side in FIG. 5 adopts a similar configuration, in such a manner that each pair of the blowers 14*a* and 14*a*', 14*b* and 14*b*', 14*c* and 14*c*', 15*a* and 15*a*', 15*b* and 15*b*, and 15*c* and 15*c*' have blowing outlets (air blowing ports) which oppose each other via the stack of paper on the placing table 12 (the paper is not shown in FIG. 5). By blowing air simultaneously from both side faces of the stack of paper (from two opposite directions) in this way, it is possible to supply air efficiently in between the sheets of paper.

The mutually facing blowers do not necessarily have to be arranged in symmetrical positions (with the axes thereof matching), and a desirable mode is one where the positions of mutually opposing air blowing ports are slightly staggered with respect to each other.

In the case of a seasoning apparatus 50 based on a confronting air flow system of this kind, exhaust openings 26 are formed in the side plates 22 and 23 where the blowers 14 and 15 are not arranged. A group of exhaust openings 26 is formed in the central portion of each of the side plates 22 and 23. In the exhaust section 27 formed in each of the side plates 22 and 23, the opening ratio on the side near the loading table 12 (the lower side) is lower than the opening ratio on the side near the ceiling plate 28 (the upper side) (see FIG. 10 to FIG. 13).

Figure 7:
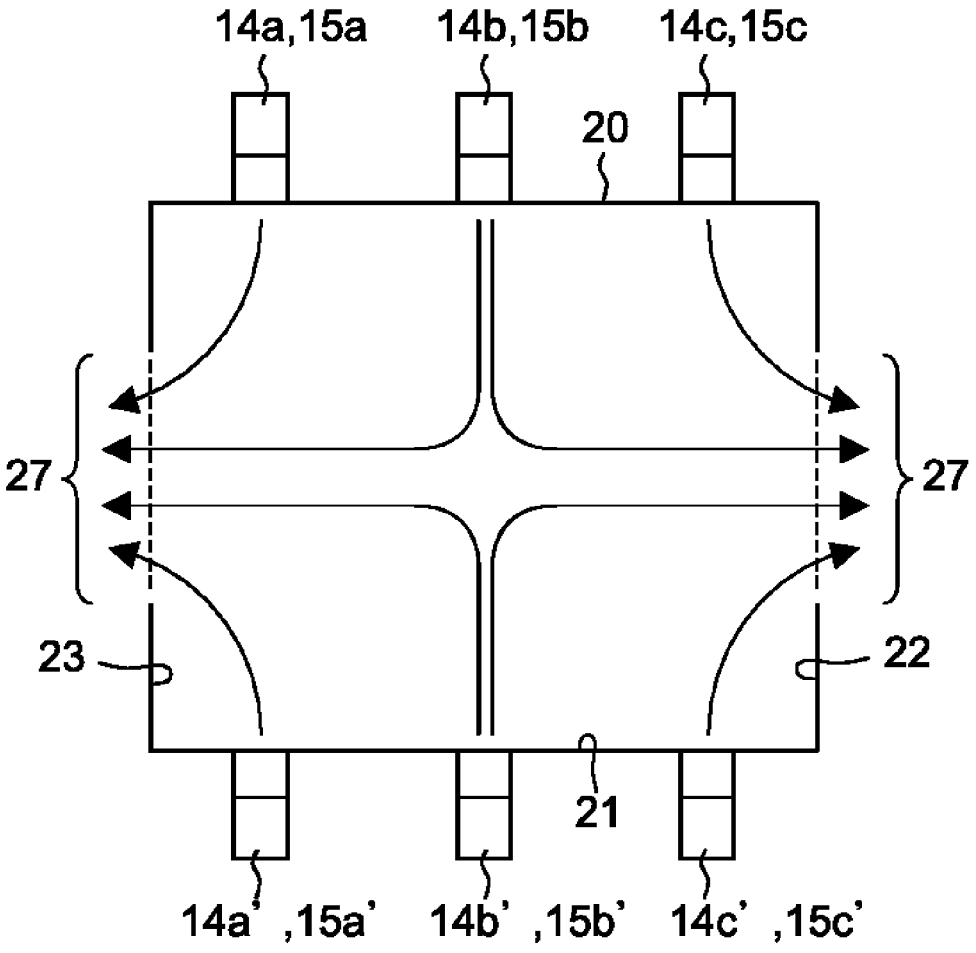
FIG. 7 is a plan diagram showing a schematic view of a flow of air inside the seasoning apparatus relating to the third embodiment.

FIG. 7 is a plan diagram showing a schematic view of a state during air blowing. The arrows in FIG. 7 give an approximate indication of the flow of air. As shown in FIG. 7, by introducing an air flow simultaneously from a group of blowers arranged in mutually opposing fashion at three substantially equidistantly spaced positions in the direction of the long edge of the paper so as to create forced convective flow of the air inside the paper to accommodating space and then cause the air to exit from the exhaust sections 27, a composition is achieved in which sufficient air is supplied between the sheets of paper while maintaining the paper in a stable attitude.

In order to achieve a stable air flow with good symmetry from two mutually opposing directions on either side of the paper 30, the driving of the blowers is controlled in such a manner that each pair of blowers which have mutually opposing blowing outlets on either side of the paper 30 (a pair of blowers 14*a* and 14*a*', a pair of blowers 14*b* and 14*b*', . . . ) each output the same air flow volume.

Composition of Exhaust Section

Figure 8A:
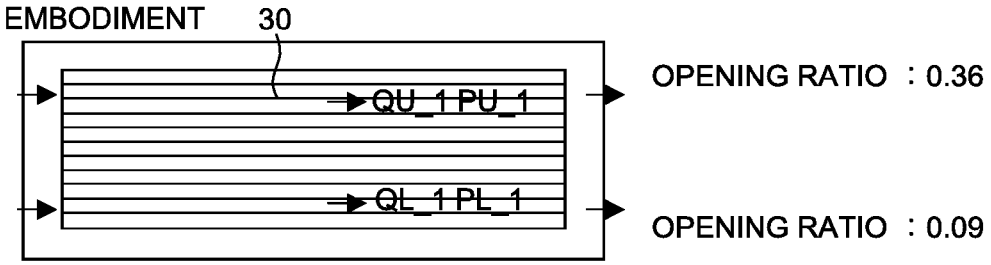
FIGS. 8A to 8C are illustrative diagrams which compare the behavior of paper when the upper side opening ratio and the lower side opening ratio in the exhaust section are different.
Figure 8B:
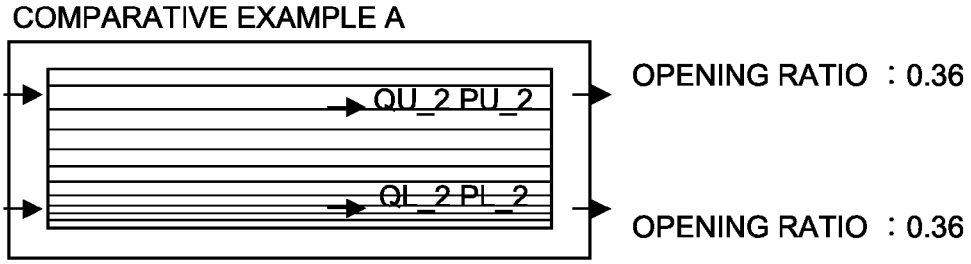
Figure 8C:
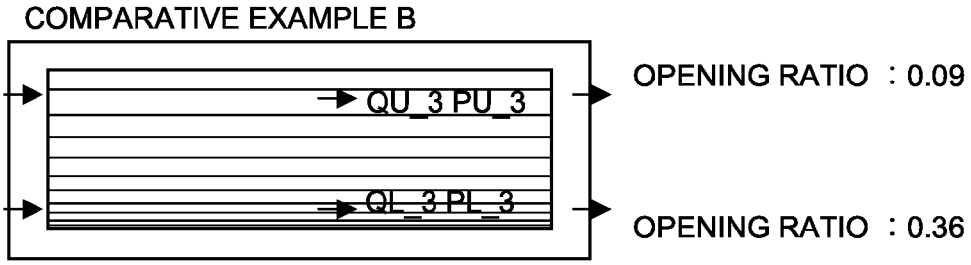

FIGS. 8A to 8C are schematic drawings of a side view of the behavior of paper when the opening ratio in the exhaust section is altered in the vertical direction. FIG. 8A shows the behavior in a case where the opening ratio on the upper side of the exhaust section is 0.36 and the opening ratio on the lower side is 0.09, which relates to an embodiment of the present invention. FIG. 8B shows the behavior in a case where the opening ratio on the upper side of the exhaust section is 0.36 and the opening ratio on the lower side is 0.36 (the opening ratio of the exhaust section is a uniform value), which relates to Comparative Example A. FIG. 8C shows the behavior in a case where the opening ratio on the upper side of the exhaust section is 0.09 and the opening ratio on the lower side is 0.36, which relates to Comparative Example B.

In the embodiment (illustrated in FIG. 8A), the flow volume of air passing the upper side of the paper accommodating space is represented as QU_1, the pressure on the upper side is represented as PU_1, the flow volume on the lower side is represented as QL_1, and the pressure on the lower side is represented as PL_1. Similarly, in the Comparative Example A (illustrated in FIG. 8B), the flow volume of air passing the upper side of the paper accommodating space is represented as QU_2, the pressure on the upper side is represented as PU_2, the flow volume on the lower side is represented as QL_2, and the pressure on the lower side is represented as PL_2, and in Comparative Example B (FIG. 8C), the flow volume of air on the upper side is represented as QU_3, the pressure on the upper side is represented as PU_3, the flow volume on the lower side is represented as QL_3, and the pressure on the lower side is represented as PL_3.

Difference Between the Embodiment and Comparative Example A

Considering the embodiment (FIG. 8A) and the Comparative Example A (FIG. 8B), since the embodiment has a lower opening ratio on the lower side compared to the Comparative Example A, then the lower side flow volume according to the embodiment (QL_1) is smaller than the lower side flow volume according to the Comparative Example A (QL_2).

$$QL_1 < QL_2 \quad \text{Relationship 1}$$

On the other hand, according to Bernouilli's theorem, in terms of air pressure, the lower side pressure according to the embodiment (PL_1) is higher than the lower side pressure according to the Comparative Example A (PL_2).

$$PL_1 > PL_2 \quad \text{Relationship 2}$$

Therefore, as shown in the drawings, in the embodiment (FIG. 8A), the gap between the sheets of paper on the lower side is larger.

In the case of Comparative Example A, the flow volume is somewhat higher than that in the embodiment, and good seasoning is achieved in portions where there is a flow of air. However, since the paper 30 is not actually flat but rather includes tilted portions and undulations, then due to the narrow gaps between the sheets of paper, there occur regions where hardly any air flows and seasoning defects arise in these locations. In this respect, it is possible to eliminate seasoning defects of this kind by ensuring sufficient gaps between the sheets, as in the embodiment.

Difference Between Comparative Example A and Comparative Example B

For the reasons described above, the upper side flow volume (QU_3) in Comparative Example B is smaller than the upper side flow volume (QU_2) in Comparative Example A.

$$QU_2 > QU_3 \quad \text{Relationship 3}$$

Consequently, in terms of the air pressure, the upper side pressure in Comparative Example B (PU_3) is higher than the upper side pressure in Comparative Example A (PU_2).

$$PU_2 < PU_3 \quad \text{Relationship 4}$$

Consequently, the gaps between the sheets on the upper side are larger in Comparative Example B than in Comparative Example A, whereas the gaps between the sheets on the lower side become yet narrower in Comparative Example B. Therefore, seasoning performance is poorer in the case of Comparative Example B.

Opening Conditions in Exhaust Section

Figure 9:
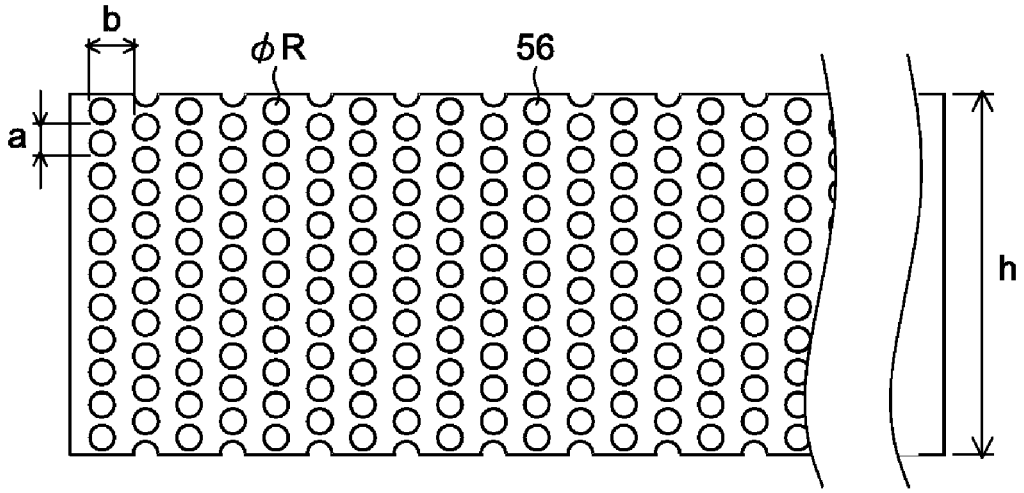
FIG. 9 is a diagram showing an opening pattern (opening condition A) of an exhaust section used for the purpose of comparison.

FIG. 9 shows an example of an opening pattern in which the opening ratio of the exhaust section is uniform in the vertical direction (opening ratio=0.36) (hereinafter, which is called "opening condition A"). In the example in FIG. 9, an opening pattern of openings arranged in a staggered matrix configuration is formed, in which openings 56 having a diameter of R=8 mm are aligned equidistantly in columns at a pitch of a=10 mm in the vertical direction, and at a column pitch b=14 mm in the lateral direction. The dimension h in the height direction of the exhaust section is taken to be 110 mm.

Figure 10:
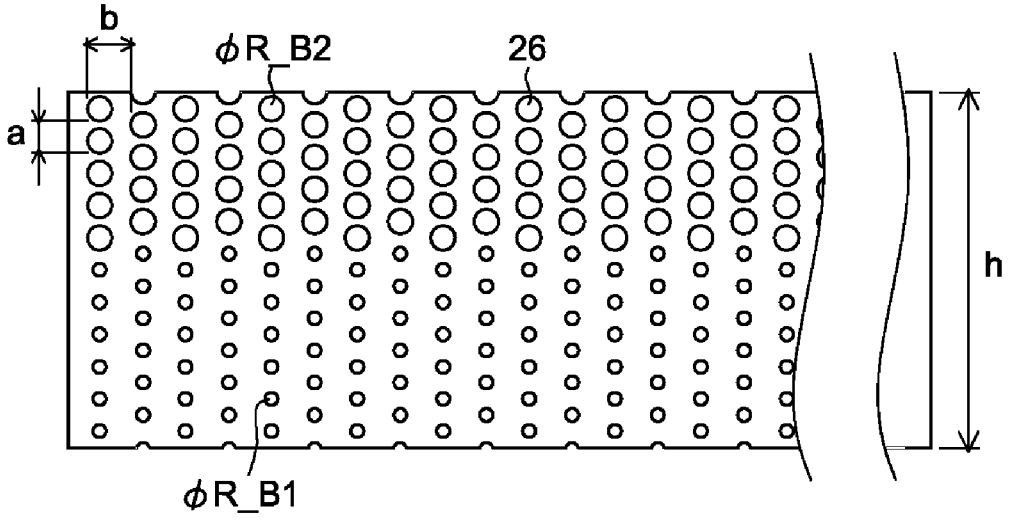
FIG. 10 is a diagram showing an example of an opening pattern of an exhaust section according to an embodiment of the present invention (opening condition B)

On the other hand, FIG. 10 shows a plan diagram of an exhaust section which corresponds to an embodiment of the present invention. In the example shown in FIG. 10, the upper side opening ratio is 0.36, similarly to FIG. 9, but the lower side opening ratio is 0.09. Below, the opening pattern shown in FIG. 10 is called "opening condition B". The opening diameter R_B1 of the group of openings formed on the lower side is 4 mm, and the opening diameter R_B2 of the group of openings formed on the upper side is 8 mm. In FIG. 10, the opening ratio is varied in the vertical direction, on either side of approximately the halfway point of the height h in the exhaust section, but various modes can be adopted for changing the opening ratio.

Figure 11:
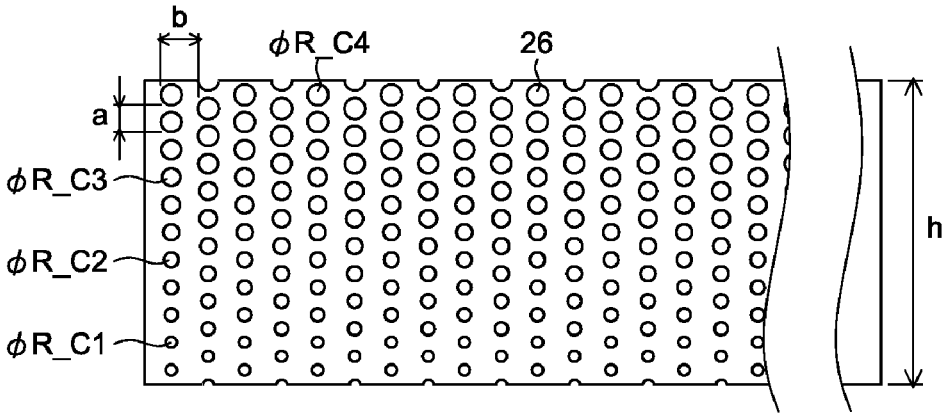
FIG. 11 is a diagram showing an example of an opening pattern of an exhaust section according to an embodiment of the present invention (opening condition C)

FIG. 11 shows a further embodiment of the present invention. In the example in FIG. 11, the opening diameter is changed gradually in stepwise fashion in accordance with the height, and the opening ratio is changed successively in multiple steps. Below, the opening pattern shown in FIG. 11 is called "opening condition C". More specifically, in FIG. 11, the opening diameter is reduced in stepwise fashion from the upper to the lower sides; and hence the opening diameters change in a stepwise fashion as follows: R_C1 diameter=3.5 mm, R_C2 diameter=5 mm, R_C3 diameter=6.5 mm, and R_C4 diameter=8 mm.

Figure 12:
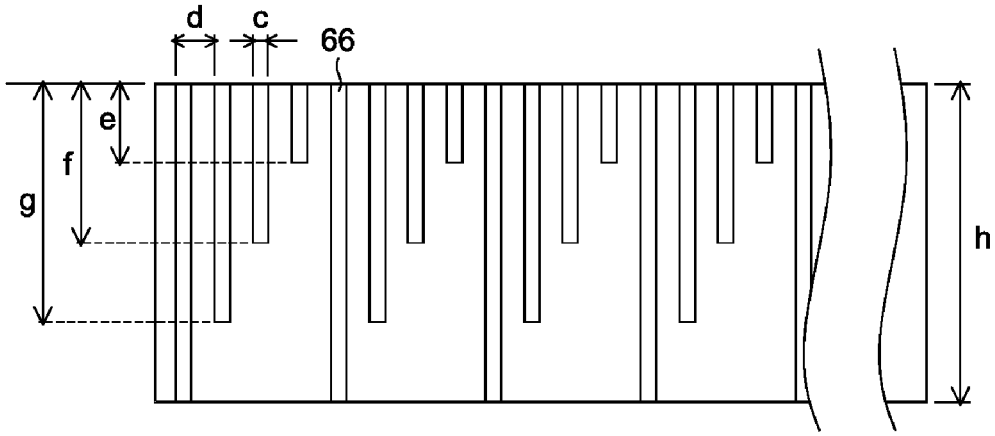
FIG. 12 is a diagram showing an example of an opening pattern of an exhaust section according to an embodiment of the present invention (opening condition D)

FIG. 12 shows a further embodiment of the present invention. In the embodiment to shown in FIG. 12, slits 66 are formed instead of circular openings 26. By altering the length of the slits which are formed in the lengthwise direction, it is possible to change the opening ratio. In the example shown in FIG. 12, the width c of each slit is 5 mm, and the interval between slits d is 14 mm. A plurality of slits 66 are formed having different lengths e, f, g, h in the downward direction with reference to the upper end. Here, e=27.5 mm, f=55 mm, g=82.5 mm and h=110 mm. By combining slits having different lengths in this way, it is possible to change the opening ratio in the vertical direction in a stepwise fashion.

Figure 13:
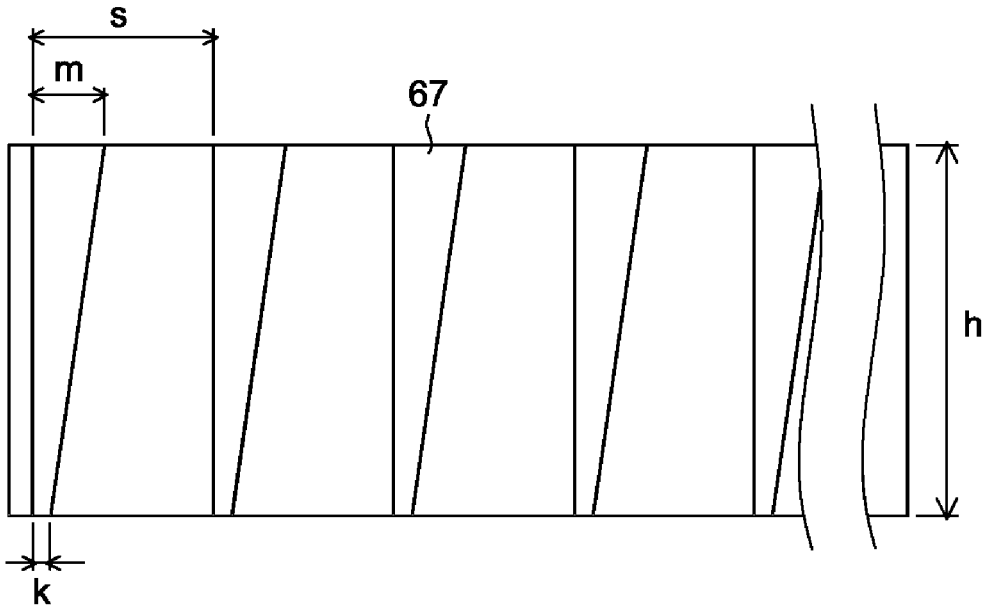
FIG. 13 is a diagram showing an example of an opening pattern of an exhaust section according to an embodiment of the present invention (opening condition E)

FIG. 13 shows yet a further embodiment of the present invention. In the embodiment shown in FIG. 13, slits 67 of which the slit width (thickness) change continuously in accordance with the height are formed. More specifically, the slit width becomes narrower (the opening ratio becomes lower), the lower the position, and the slit 67 width becomes larger (the opening ratio increases) as the height increases. Below, the opening pattern shown in FIG. 13 is called "opening condition D".

In FIG. 13, the width of the bottommost end of the slits 67 is k=5 mm, the width of the uppermost end thereof is m=20 mm, and the slit spacing in the lateral direction is s=56 mm.

Figure 14:
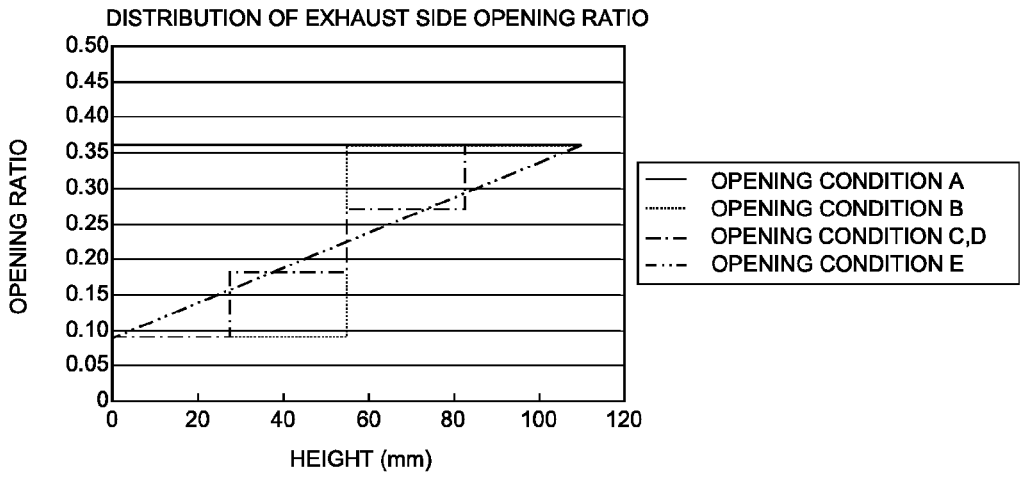
FIG. 14 is a graph showing the opening ratio distribution of the opening conditions A to E.

The distribution of the opening ratios under the opening conditions A to E described in relation to FIG. 9 to FIG. 13 is summarized in FIG. 14. The horizontal axis in FIG. 14 represents the height of the exhaust section (unit: mm) and the vertical axis represents the opening ratio. As shown in FIG. 14, it is possible change the opening ratio in a stepwise fashion (opening conditions B to D), or in a continuous fashion (opening condition E).

In the opening conditions B to D (FIG. 10 to FIG. 12), the opening ratio is changed in divisions which are substantially equally spaced in the height direction of the exhaust section, but the invention is not limited necessarily limited to a mode using equally spaced divisions. Furthermore, the invention is not limited to a mode where the amount of change in the opening ratio is changed in a substantially linear fashion.

A desirable opening ratio distribution for implementing embodiments of the present invention is one where the lower side opening ratio (minimum value) is 1/20 or greater and 2/3 or less of the upper side opening ratio (maximum value).

The dimensions shown in FIG. 10 to FIG. 13 are examples, and in implementing embodiments of the present invention, various design modes are possible.

Results of Evaluation of Seasoning Performance

The seasoning performance for printing paper was evaluated in seasoning apparatuses according to Practical Examples 1 and 2, and Comparative Examples 1 and 2, taking the apparatus composition described in the first embodiment (FIG. 1) to be "Practical Example 1", taking the apparatus composition described in the second embodiment (FIGS. 4A and 4B) to be "Practical Example 2", taking a composition where the opening ratio of the exhaust section of the apparatus composition described in the first embodiment (FIG. 1) was changed to a uniform ratio in the vertical direction, to be "Comparative Example 1", and taking a composition where the opening ratio of the exhaust section of the apparatus composition described in the second embodiment (FIGS. 4A and 4B) was changed to a uniform ratio in the vertical direction, to be "Comparative Example 2".

Evaluation Conditions (1) Paper Printing Conditions

Conditions of paper used: OK Top Coat (product name) manufactured by Oji Paper Co., Ltd., 157 gsm, Half Kiku size (636 mm×469 mm)

Printing apparatus used Inkjet printing apparatus

Conditions of printed image: Full area solid image. Evaluated images of two types using an ink deposition volume of 5 g/m$^2$ and 10 g/m$^2$ respectively (2) Conditions of Seasoning Apparatus Opening conditions of exhaust section: Opening condition B in Practical Examples 1 and 2, and opening condition A in Comparative Examples 1 and 2.

Blower: 12 Blowers "San Ace B97 (9BMB24P2K01)" (product name) manufactured by SANYODENKI CO., LTD., with static pressure of 1280 Pa, the speed of blowers controlled by speed control signal (duty of square wave).

Blower control conditions: The driving was performed by square wave duty of 60% in the upper-tier blowers and square wave duty of 100% in the lower-tier blowers.

Spacing between the ceiling plate and the base plate (loading table): 110 mm (3) Evaluation Method Seasoning was carried out for five minutes on a stack of paper on which the printing has been performed by the inkjet printing apparatus in a 23° C./50% RH environment, and the amount of water remaining in the paper after the seasoning was measured. A measurement to sample was taken out once every four sheets from the stack of paper after the seasoning, and the measurement was carried out. The amount of water was measured by a weighing method. The seasoning performance was judged to be satisfactory if this amount of water was equal to or less than 0.3 g/m$^2$ with respect to the amount of water contained in the paper initially. The evaluation was started with ten sheets of printing paper, the number of sheets of paper was progressively increased, ten sheets at a time, and the seasoning capability was evaluated on the basis of the maximum number of sheets at which satisfactory performance was achieved. The evaluation results are indicated in Table 1 below.

TABLE 1

| Evaluation results | | | | | |
|---|---|---|---|---|---|
| | | Shape of Ceiling plate/Base plate | Opening ratio on exhaust side | Image | Seasoning capacity (Number of sheets) |
| Experiment 1 | Comparative Example 1 | Flat | Opening condition A | Ink deposition volume 5 g/m$^2$ | 70 sheets |
| Experiment 2 | Comparative Example 1 | Flat | Opening condition A | Ink deposition volume 10 g/m$^2$ | 50 sheets |
| Experiment 3 | Practical Example 1 | Flat | Opening condition B | Ink deposition volume 5 g/m$^2$ | 110 sheets |
| Experiment 4 | Practical Example 1 | Flat | Opening condition B | Ink deposition volume 10 g/m$^2$ | 90 sheets |
| Experiment 5 | Comparative Example 2 | Curved | Opening condition A | Ink deposition volume 5 g/m$^2$ | 80 sheets |
| Experiment 6 | Comparative Example 2 | Curved | Opening condition A | Ink deposition volume 10 g/m$^2$ | 70 sheets |
| Experiment 7 | Practical Example 2 | Curved | Opening condition B | Ink deposition volume 5 g/m$^2$ | 110 sheets |
| Experiment 8 | Practical Example 2 | Curved | Opening condition B | Ink deposition volume 10 g/m$^2$ | 110 sheets |

As indicated by the experiment results in Table 1, improvement in the seasoning performance is observed with the opening condition B, compared to the opening condition A (uniform opening ratio between the upper and lower parts in the vertical direction). When the state of the air flow between the sheets was observed under the opening condition A, the gap between the paper sheets was large on the upper side of the paper stack, whereas on the lower side, the gaps were inclined to be blocked and passage of air was observed to be poor.

Under the opening condition B, it was observed that the paper gap was uniform and the passage of air on the lower side was improved. It is possible to increase the pressure of to the air on the lower side compared to the upper side by reducing the opening ratio on the lower side of the exhaust section, and it is inferred that by this means, the effects of gravity is overcome in such a manner that an air flow can be passed satisfactorily between the sheets of the paper on the lower side.

Furthermore, as is clear from a comparison between "Experiment 1 and Experiment 2" and a comparison between "Experiment 3 and Experiment 4", when the ink deposition volume was increased to 10 g/m$^2$, paper curl became severe and deterioration of the state of air flow was observed. In accordance with this, deterioration in seasoning was also observed.

In response to this, it was observed that by using a seasoning apparatus having a paper loading surface with a curved shape and a paper restricting surface with a curved shape, it was possible to correct curl of the paper in the air blowing direction and performance was improved (see comparison between "Experiment 2 and Experiment 6"). However, in the case of the opening condition A (Experiment 5 and Experiment 6), slight deterioration in performance was observed with increase in the ink deposition volume (from Experiment 5 to Experiment 6).

On this point, as shown by Experiments 7 and 8, in a seasoning apparatus in which the paper loading surface and the paper restricting surface had a curved shape (the apparatus described in relation to FIG. 3 (or FIG. 5)), in the case of a composition where the opening ratio to was reduced on the lower side of the exhaust section, no deterioration due to increase in the ink volume was measured and an extremely good air blowing state was observed. This is inferred to be because, as described in relation to FIG. 8, the increase in the pressure of the air on the lower side compared to on the upper side also contributes to stabilizing the attitude of the paper and alleviating the effects caused by the curl.

In Experiments 1 to 8 described above, the conditions on the air blowing side are such that the air flow intensity of the lower-tier blowers is set to be stronger than the intensity of the upper-tier blowers, but various modes are possible in respect of the distribution of the air flow intensity in the vertical direction: for instance, the intensity of the upper and lower blowers can be made equal, or the air blowing intensity of the upper-tier blowers can be made stronger than the intensity of the lower-tier blowers. There are merits and demerits in seasoning performance depending on the setting of the air blowing intensity distribution, but proportionate beneficial effects based on the opening condition of the exhaust section can be obtained (an effect that the pressure on the lower side is raised by lowering the opening ratio on the lower side, in such a manner that the gap between the paper sheets is thereby guaranteed).

Modification Example 1

It is possible to achieve a composition in which the width of the paper accommodating space 34 in the x direction and/or the y direction can be adjusted freely by adopting a slidable structure for at least one side plate, and desirably two or more mutually adjacent side plates, of the side plates 20 to 23 which are described in the first embodiment to the third embodiment. For example, the side plates 21 to 23 in FIG. 1 are each composed so as to be advanceable and retractable in the front/rear direction, so as to achieve a composition in which the surface area of the paper accommodating region demarcated by the side plates 20 to 23 can be increased or reduced. By adopting a composition of this kind, it is possible to handle papers of different sizes. By sliding the side plate(s) in accordance with the size of the paper used, the size of the paper accommodating space 34 can be adjusted to suit the paper. If the paper size is restricted to a particular type(s) (for example, only A4 size and A3 size), then it is possible to adopt a composition where only one of the side plates 20 to 23, for example, only the side plate 21, is movable.

Description of Control System

Figure 15:
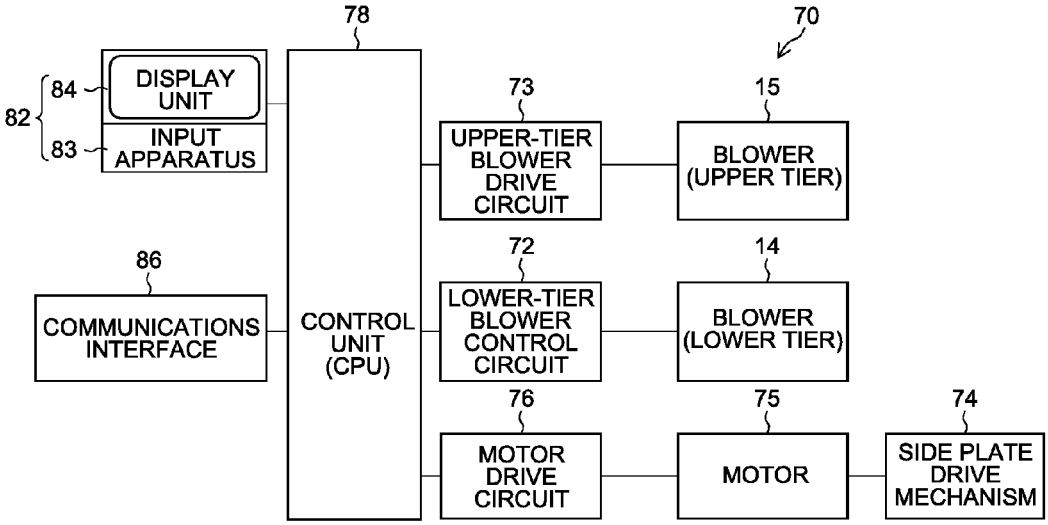
FIG. 15 is a block diagram showing an example of the composition of a control system of a seasoning apparatus.

FIG. 15 is a block diagram showing a principal composition relating to a control system of a seasoning apparatus. Here, a seasoning apparatus 70 having a paper size adjustment function is described as an example. The seasoning apparatus 70 includes a drive circuit 72 for driving the lower-tier blowers 14, a drive circuit 73 for driving the upper-tier blowers 15, a drive mechanism 74 necessary for driving the side plate 21, and the like, a motor 75 and a drive circuit 76 thereof which form a drive source for driving the drive mechanism 74, and a control unit 78.

The control unit 78 is constituted by a central processing unit (CPU) and peripheral circuits thereof, for example, and supplies control signals to the respective drive circuits (72, 73, 76) in accordance with a prescribed program, thereby controlling the operation of the motor 75 and the blowers 14 and 15. This control unit 78 serves the role of an air blowing control device in terms of varying and controlling the distribution of the air flow volume in the vertical direction by controlling the output air blowing volume (air blowing intensity) of the lower-stage blowers 14 and the upper-stage blowers 15.

In the seasoning apparatus 70, an operating unit 82 is provided as a user interface. The operating unit 82 comprises an input apparatus 83 via which an operator (user) can perform various inputs, and a display unit (display monitor) 84. The input apparatus 83 can use various different modes, such as a keyboard, a mouse, a touch panel, buttons, and the like. By controlling the input apparatus 83, the operator is able to input printing conditions (paper type, paper name, paper size, and other attribute information, printing mode, etc.), as well as performing inputting/editing of additional information and searching of information, and the like. Various information such as the input contents and search results, and the like, can be confirmed via the display on the display unit 84.

Furthermore, the seasoning apparatus 70 comprises a communications interface 86, and information can be obtained directly via the communications interface 86 from an external apparatus (not illustrated) such as a control circuit of the printing apparatus or a host computer, or the like. The communications system of the communications interface 86 is not limited in particular, and may be a wired or wireless system. The devices for acquiring information from an external source may comprise a media interface which reads and writes from and to an external storage medium (removable media), either instead of or in addition to the input apparatus 83 and the communications interface 86.

It is also possible to acquire the attribute information of the paper (such as paper size, paper type, name, and the like), and information on the amount of ink deposited on the to printing paper, by means of these devices. The amount of ink deposited on the paper can be calculated from the image data that is the object of printing.

According to the seasoning apparatus 70 shown in FIG. 15, it is possible to variably control the position of side plates and to control an appropriate air flow volume and to control the air blowing time in accordance with the attributes of the paper, such as the paper type and paper name, the paper size, and so on. For example, the optimal seasoning time, the timing at which the vertical air flow volume distribution is switched, and the balance of air flow volumes, and the like, corresponding to the attributes of the paper used, are decided in advance by experimentation, or the like, and the related information is stored in a storage device, such as a ROM, in the form of a data table. The control unit 78 controls the air blowing in accordance with the relevant conditions, by referring to this data table.

According to the present seasoning apparatus 70, it is possible to control the air flow volume and to control the air blowing time in accordance with the amount of ink deposited on the paper 30. Similarly to the foregoing, the optimal seasoning time, the timing at which the vertical air flow volume distribution is switched, and the balance of air flow volumes, and the like, corresponding to the amount of ink, are decided in advance by experimentation, or the like, and the related information is stored in a storage device, such as a ROM, in the form of a data table. The control unit 58 controls air blowing in accordance with the relevant conditions, by referring to this data table. As the amount of ink is greater, the air blowing time becomes longer. It is possible to employ control systems achieved by properly combining elements, such as the above-described attributes of the paper sheet and the ink volume, and the like.

Modification Example 2

Figure 16:
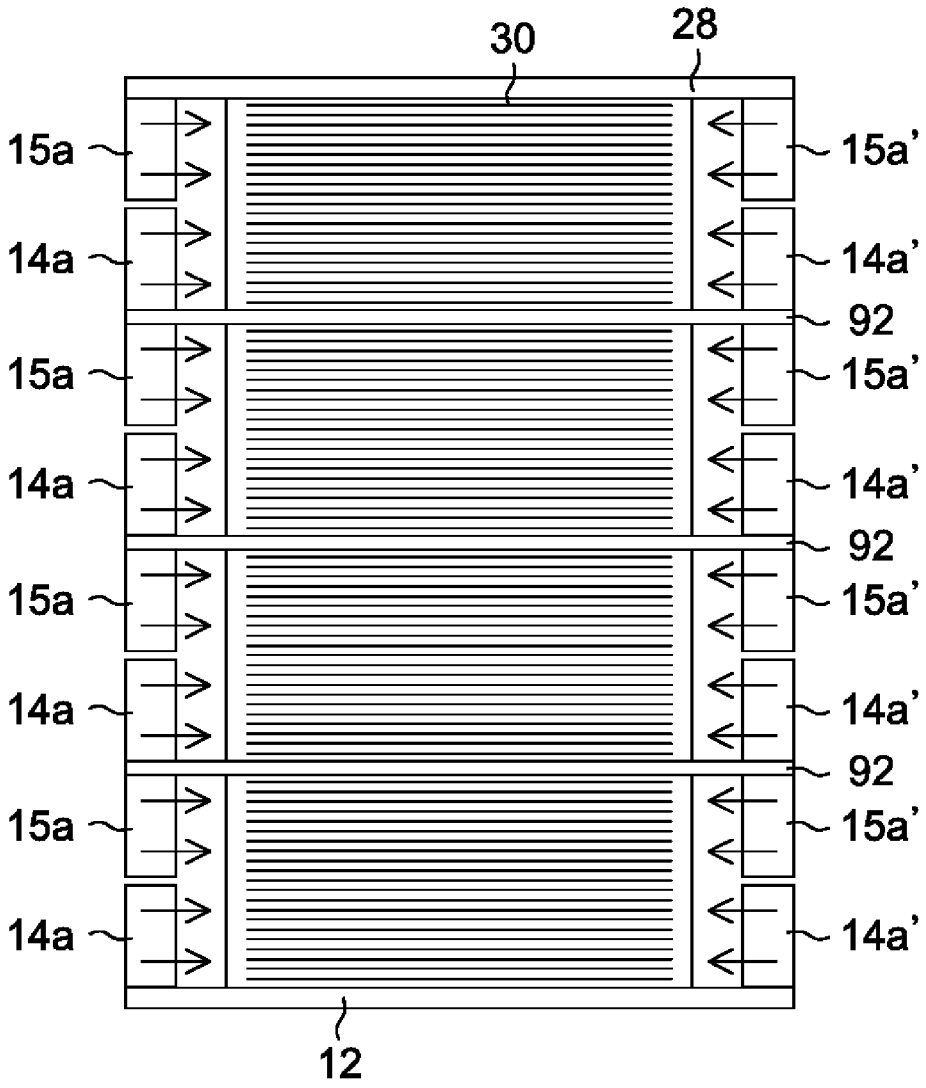
FIG. 16 is a principal part schematic drawing showing a further embodiment.

FIG. 16 is a schematic drawing showing yet a further embodiment of the present invention. FIG. 16 is a side view diagram showing a schematic view of a state during air blowing. In FIG. 16, elements which are the same as or similar to the composition described in FIG. 6 are labelled with the same reference numerals, and description thereof is omitted here.

As shown in FIG. 16, it is possible to adopt a composition in which shelf plates 92 are arranged in the paper accommodating section on the loading table 12, and the sheets of paper 30 are separately stacked on a plurality of decks. FIG. 16 shows an example in which the to paper accommodating section is divided into four decks by three shelf plates 92, and the number of shelf plates 92 can be suitably set to one or more, in accordance with the number of decks to be divided. By arranging n (n is a natural number) shelf plates 92 between the loading table 12 and the ceiling plate 28, (n+1) decks (accommodating units) are prepared.

For the device which puts the paper 30 in and out the respective decks of the paper accommodating section, it is possible to employ a commonly known structure such as "drawers". Although the detailed structure is not shown in the drawings, it is possible to draw out each deck of the paper accommodating section and set a stack of paper on each deck. An upper-stage blower and a lower-stage blower 14 and 15 similar to those shown in FIGS. 1, 3 and 6 are arranged for each of the separated decks, and the air flow distribution in the vertical direction can be controlled in respect of the paper stacks on each deck. Looking at each deck in particular, the shelf plates 92 function as members corresponding to the "loading table" or the "ceiling plate".

According to this mode, it is possible to pass a sufficient air flow over the paper stacked in a lower position, and therefore the seasoning of a large number of sheets of paper 30 can be attained in a short period of time.

Description of Air Blowing Conditions Required for Seasoning

Conditions of Air Flow Volume

In order to carry out seasoning quickly in respect of a large number of printed matters (a stack of printed paper sheets), it is necessary to blow an air flow between the sheets at all times at a prescribed air flow volume or above. Suitable air flow volume conditions for seasoning are clarified by means of an evaluation experiment described below.

Evaluation Method

Step 1

Figure 17:
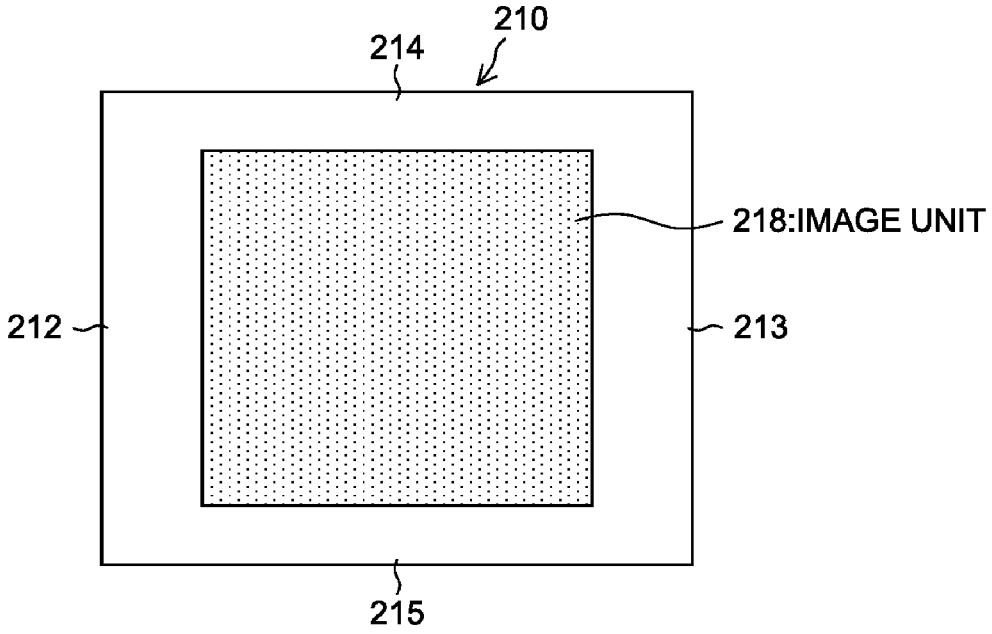
FIG. 17 is an illustrative diagram of a printed object used for evaluating air flow volume conditions.

As shown in FIG. 17, a solid image (the image portion indicated by reference numeral 218) was printed by an inkjet recording apparatus while the left and right margin portions 212, 213 and upper and lower margin portions 214, 215 of a suitable amount were ensured on the printed paper 210. Here, the remaining water volume contained in the image portion 218 after printing was approximately 2.5 ($g/m^2$). A1 grade gloss coated paper, "Tokubishi Art double-side N" (product name), made by Mitsubishi Paper Mills Limited was used as the printing paper 210.

Step 2

Figure 18A:
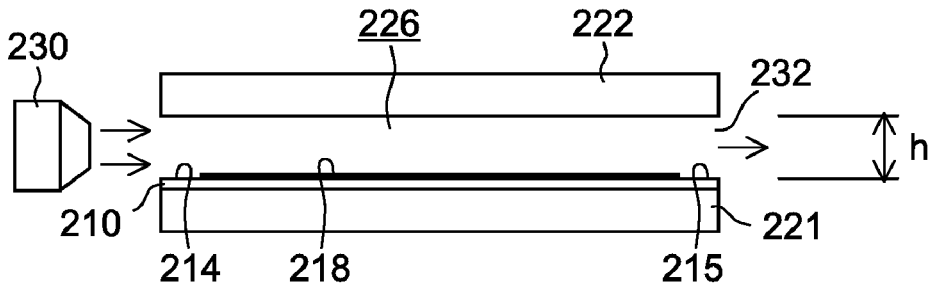
FIGS. 18A and 18B are illustrative diagrams of a method of evaluating air flow volume conditions.
Figure 18B:
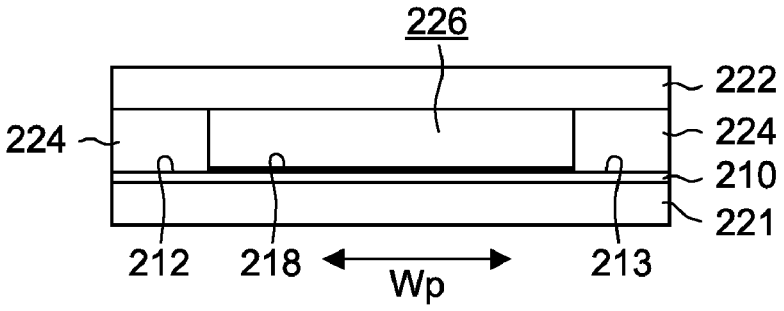

As shown in FIGS. 18A and 18B, the paper after printing in this fashion (printed matter) was sandwiched between two plates 221, 222, and a gap 226 of a prescribed thickness was formed between the plates 221 and 222 by spacers 224. More specifically, printing paper 210 was placed on the plate 221 in such a manner that the image portion 218 faced upward, spacers 224 of a prescribed thickness were placed on the left and right-hand margin portions 212, 213, and the plate 222 was placed on the spacers 224. The plate 221 was a member corresponding to the loading table, and the plate 222 was a member corresponding to the ceiling plate. In this way, a gap of a prescribed height h was formed on the image portion 218 of the printing paper 210. FIG. 18B is a diagram of the device viewed from the side of the blower (air blowing device) 230 illustrated in FIG. 18A.

Step 3

Next, the blower 230 blew a flow of air into the gap 226. For the blower 230, a Blower "San Ace B97 (9BMB24P2K01)" (product name) manufactured by SANYODENKI CO., LTD. was used. The output air flow volume was controlled by controlling the input current of the blower.

The air flow speed v (m/s) was measured at the output portion 232 of the air blowing path formed between the two plates 221 and 222 in FIG. 18A, and the air flow volume q per unit length of paper in the breadthways direction of the paper (Wp direction in FIG. 18B), $q=h \cdot v$ ($m^2/min$), was calculated using the height h of the gap 226 (which corresponded to the paper gap). An "Anemomaster air speed meter MODEL6004" (product name) manufactured by Kanomax Japan, Inc. was used for the flow speed meter.

Step 4

In this way, after blowing an air flow for a prescribed period of time while maintaining a certain air flow volume, the air blowing was halted; the paper 210 was removed; and the amount of remaining water w ($g/m^2$) was measured. The measurement method is as described below.

Water Amount Measurement Method

The amount of water contained in the printing paper 210 was measured by cutting out an extracted 3 cm by 3 cm measurement portion of the paper and using a trace water content measurement apparatus (here, using a "CA-200" (product name) manufactured by Mitsubishi Chemical Analytech Co., Ltd.). The measured amount of water (g) was divided by the extracted surface area to derive the amount of water per unit surface area ($g/m^2$).

The definition of "remaining amount of water" means the amount of water remaining after ejecting ink droplets and drying minus the amount of water contained in the paper before printing. In other words, the amount of water originally contained in the printing paper itself was subtracted, and only the amount of water originating from the ink deposited by printing was considered. The amount of water contained in the paper was measured separately using unprinted paper.

Step 5

The air blowing time whereby the remaining amount of water w measured by steps 1 to 4 becomes less than 0.5 ($g/m^2$) was defined as the seasoning time.

Figure 19:
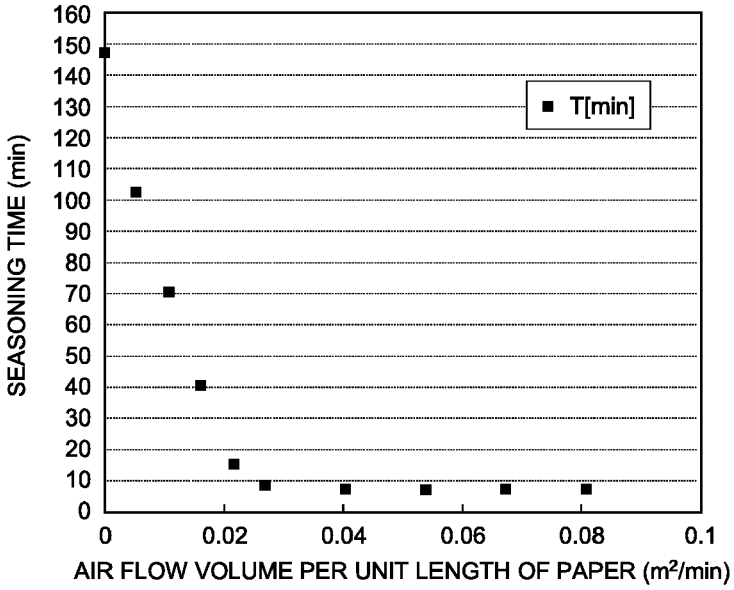
FIG. 19 is a graph showing the correlation between the air flow volume and seasoning time.

The relationship between the air flow volume per unit length of paper thus determined (air flow volume between sheets) and the seasoning time is shown in FIG. 19.

Evaluation Results

As FIG. 19 reveals, it was found that under the conditions where the air flow volume q per unit length of paper was equal to or greater than 0.02 ($m^2/min$), rapid seasoning could be carried out in 15 minutes or less.

Conditions of Air Flow Static Pressure

Furthermore, in order to pass an air flow between a large number of printed matters (a stack of printed paper sheets), it is necessary to achieve a static pressure of the air flow which is sufficient to overcome the pressure loss. In general, a fluid passing between parallel plates has a pressure loss $P_{loss}$ as expressed by the following Expression 1.

$$P_{loss} = 12\eta \frac{L}{h^2} V \quad \text{Expression 1}$$

where $P_{loss}$ represents a pressure loss (Pa), v represents an air flow speed (m/s), h represents a gap (m), L represents a flow channel length (m) and η represents viscosity (Pa·s).

The gap between paper sheets, h, is principally restricted by the number of sheets placed on the loading table, and the distance between the loading table and the ceiling plate. The greater the gap h, the greater the extent to which the pressure loss can be reduced, but there are restrictions in relation to increase in the size of the apparatus and the liability of to flapping or folding of the paper caused by the blowing of air, and in practice the gap having h=approximately 0.5 mm is desirable.

Figure 20:
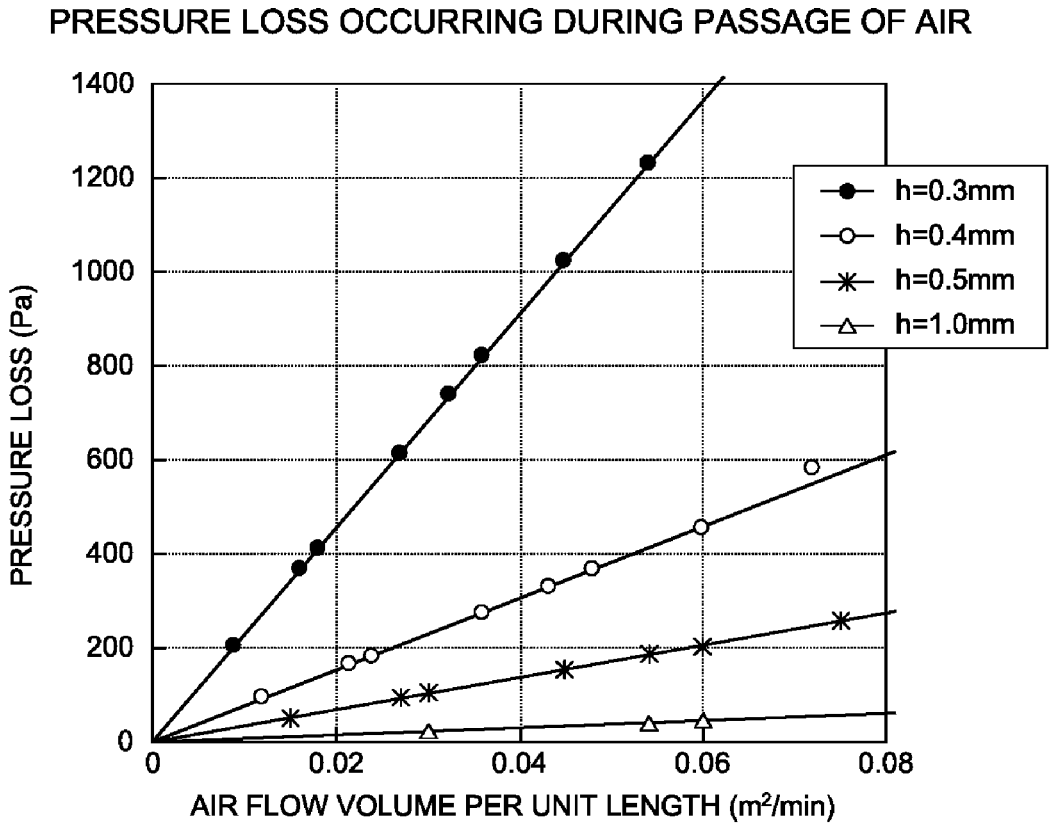
FIG. 20 is a graph showing the correlation between the air flow volume and pressure loss.

In this case, in relation to the air flow static pressure required in the air blowing device, the required air volume is required to be satisfied at a paper gap of h=0.3 mm approximately, taking account of non-uniformities in the air flow. FIG. 20 shows the relationship between the flow volume passing between the paper sheets and the pressure loss, supposing that the air blowing distance L is the short side of half Kiku paper (469 mm), which is commonly used as printing paper.

From FIG. 20, it is clear that an air flow static pressure of 500 (Pa) is necessary in order to satisfy the air flow volume q per unit length being 0.02 ($m^2$/min) (i.e. q=0.02 ($m^2$/min)) at a gap of h=0.3 mm Capacity of Air Blowing Units and Seasoning Performance The relationship between the capacity of the air blowing units and the seasoning performance was investigated under the following conditions.

Maximum number of sheets processed M=200 sheets

Length of one side (long side) of paper=636 mm (paper size: half Kiku)

Required air flow volume Q=200×0.636×0.02=2.54 ($m^3$/min)

Required static pressure P=500 (Pa)

The following compositions were compared as air blowing units.

Air blowing unit A: San Ace B97 (9BMB24P2K01) manufactured by SANYODENKI CO., LTD.

Air blowing unit B: EH5402 manufactured by Matsushita Electric Industrial Co. Ltd (Panasonic Corporation)

Air blowing unit C: San Ace 92 (9G0924A2011) manufactured by SANYODENKI CO., LTD.

Figure 21:
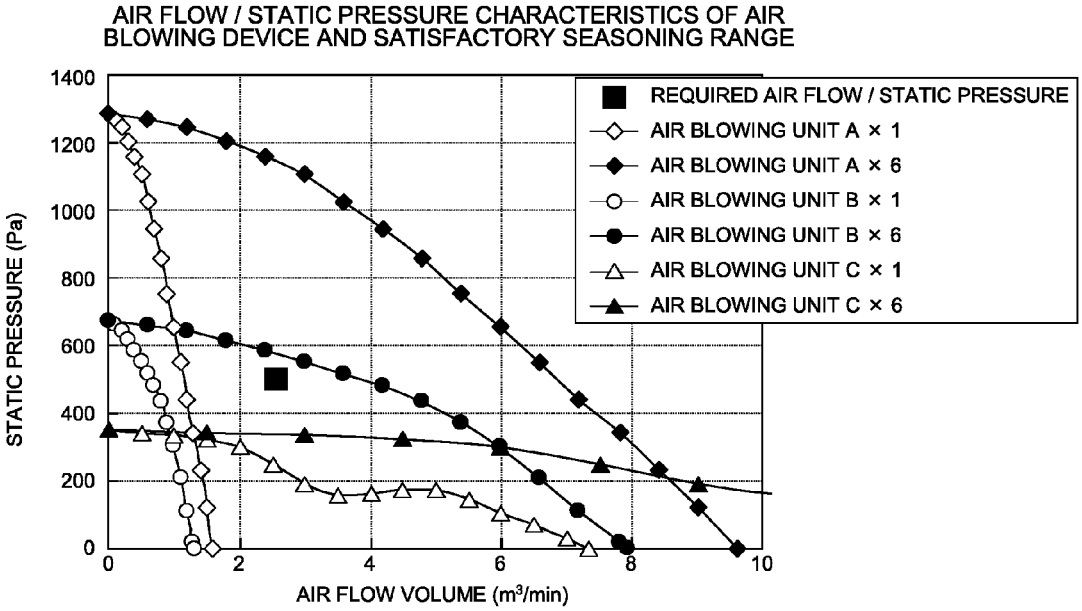
FIG. 21 is a graph showing the relationship between the air flow volume and static to pressure characteristics of an air blowing device, and the air flow volume and static pressure conditions required to achieve good seasoning.

FIG. 21 is a graph showing the relationship between the air flow volume and static pressure for different types and numbers of air blowing unit A to C. In FIG. 21, the points indicated by the black square dots are points representing conditions required in order to to achieve satisfactory seasoning, satisfying "required air flow volume Q=200×0.636×0.02=2.54 ($m^3$/min)" and "required static pressure P=500 (Pa)". The required air flow volume Q is calculated by Q=M×Wp×0.02 ($m^3$/min), where M is the maximum number of processed sheets (sheets) and Wp is the length (m) of one side of the paper as viewed from the air blowing direction.

As shown in FIG. 21, the air flow volume-static pressure characteristics (Q-P characteristics) in a case where the air blowing device is constituted by 6 air blowing units A or by 6 air blowing units B encompass the point (Q, P) which indicates the minimum required air blowing conditions described above.

Therefore, rapid seasoning can be achieved by using an air blowing device constituted by 6 air blowing units A or 6 air blowing units B.

On the other hand, when an air blowing device is constituted by 6 air blowing units C, the required static pressure P=500 (Pa) is not satisfied and rapid seasoning is difficult to achieve.

Similarly, a composition where one of each of the air blowing units A to C is used also fails to satisfy the required air flow volume Q and the required static pressure P simultaneously, and therefore it is difficult to achieve rapid seasoning.

Comparing the point representing the required air flow volume value Q=M×Wp×0.02 ($m^3$/min) and the required static pressure value P=500 (Pa) with the characteristics curve graph of the air blowing device, if the point representing required air blowing conditions as described above is situated on the characteristics curve or in the region below the characteristics curve, then it is possible to achieve air blowing which satisfies the required air blowing conditions by means of the air blowing device.

If excessive flapping of the paper occurs due to excessive air flow volume and air flow pressure, then folding of the paper and damage to the image can occur. Therefore, the upper limits of the air flow volume and the static pressure during air blowing are specified so as to prevent excessive flapping movement of the paper.

Timing of Carrying Out Seasoning

There are no particular restrictions on the timing of carrying out seasoning, and the seasoning may be carried out at the following timings, for example.

(1) If single-side printing only is being performed, then the seasoning is carried out after to printing on the single side.

(2) If double-side printing is being performed, then the seasoning is carried out after printing on the front surface and before printing on the rear surface.

(3) If double-side printing is being performed, then in addition to the timing indicated by the case in item (2) above, the seasoning is also carried out after printing on the rear surface.

Example of Application to Inkjet Printing System

An example of a printing system which combines a seasoning apparatus relating to embodiments of the present invention shown in FIG. 1 to FIG. 3 and FIG. 5 to FIG. 7, and the like, and an inkjet printing apparatus is now described.

Figure 22:
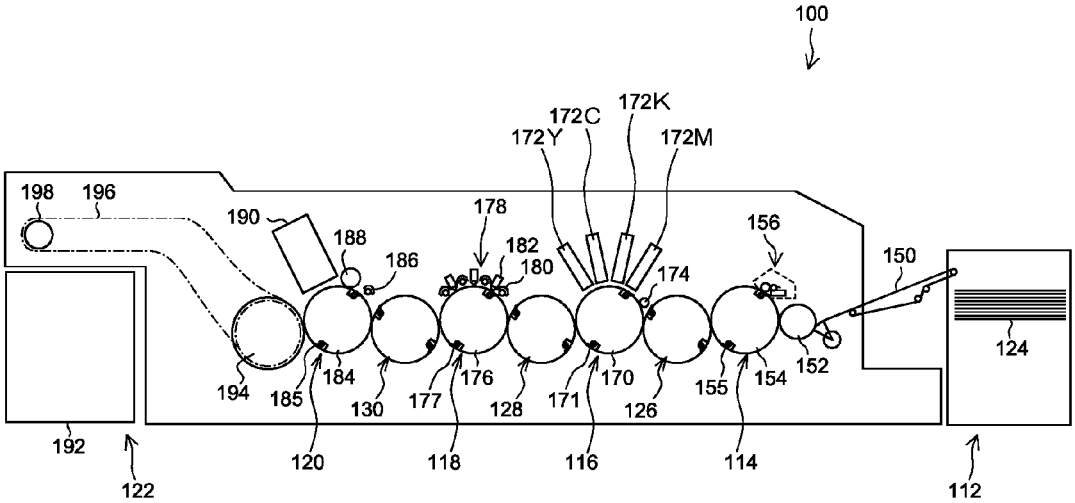
FIG. 22 is a schematic drawing of an inkjet recording apparatus relating to an embodiment of the present invention.

FIG. 22 is an example of the composition of an inkjet recording apparatus relating to an embodiment of the present invention. This inkjet recording apparatus 100 is an inkjet recording apparatus using a pressure drum direct image formation method which forms a desired color image by ejecting droplets of inks of a plurality of colors from inkjet heads 172M, 172K, 172C and 172Y onto a recording medium 124 (called "paper" below for the sake of convenience) held on a pressure drum (image formation drum 170) of an image formation unit 116. The inkjet recording apparatus 100 is an image forming apparatus of an on-demand type employing a two-liquid reaction (aggregation) method in which a treatment liquid (here, an aggregating treatment liquid) is deposited on a recording medium 124 before ejecting droplets of ink, and the treatment liquid and ink liquid are caused to react together, forming an image is formed on the recording medium 124.

As shown in FIG. 22, the inkjet recording apparatus 100 principally includes a paper feed unit 112, a treatment liquid deposition unit 114, an image formation unit 116, a drying unit 118, a fixing unit 120 and a paper output unit 122.

The seasoning apparatus 10 (or 40, 50 and 70) described in relation to FIGS. 1 to 3 and FIGS. 5 to 7, and the like, is disposed in the portion of the output tray 192 of the paper output unit 122 (which corresponds to the "paper output section").

Paper Supply Unit

The paper supply unit 112 is a mechanism for supplying a recording medium 124 to the treatment liquid deposition unit 114, and recording media 124 each of which is cut sheet paper are stacked in the paper supply unit 112. A paper supply tray 150 is provided with the paper supply unit 112, and a recording medium 124 is supplied one sheet at a time to the to treatment liquid deposition unit 114 from the paper supply tray 150.

In the inkjet recording apparatus 100 according to the present example, it is possible to use recording media 124 of a plurality of types having different materials and dimensions (paper size). It is also possible to use a mode in which a plurality of paper trays (not illustrated) for separately stacking recording media of different types respectively are provided in the paper supply unit 112, and a paper supplied to the paper supply tray 150 is switched automatically amongst the plurality of paper trays, or a mode in which the operator selects the paper tray or replaces the paper tray according to requirements. In the present embodiment, cut sheet paper (cut paper) is used as the recording media 124, but it is also possible to adopt a composition in which paper supply is attained by obtaining a recording medium with the required size by cutting a continuous roll (rolled paper).

Treatment Liquid Deposition Unit

The treatment liquid deposition unit 114 is a mechanism which deposits treatment liquid onto a recording surface of the recording medium 124. The treatment liquid includes a coloring material aggregating agent which aggregates the coloring material (in the present embodiment, the pigment) in the ink deposited by the image formation unit 116, and the separation of the coloring material and the solvent of the ink is promoted due to the treatment liquid and the ink making contact with each other.

As shown in FIG. 22, the treatment liquid deposition unit 114 includes a paper supply drum 152, a treatment liquid drum 154 and a treatment liquid application apparatus 156. The treatment liquid drum 154 is a drum which holds the recording medium 124 and rotates to convey the medium. The treatment liquid drum 154 has hook-shaped gripping devices (grippers) 155 provided on the outer circumferential surface thereof, and is devised in such a manner that the leading end of the recording medium 124 can be held by gripping the recording medium 124 between the hook of a holding device 155 and the circumferential surface of the treatment liquid drum 154. The treatment liquid drum 154 may include suction holes provided in the outer circumferential surface thereof, and be connected to a suctioning device which performs suctioning via the suction holes. By this means, it is possible to hold the recording medium 124 on the circumferential surface of the treatment liquid drum 154 in a state where the recording medium 124 is being in close contact with the circumferential surface of the treatment liquid drum 154.

A treatment liquid application apparatus 156 is provided opposing the circumferential surface of the treatment liquid drum 154, to the outside of the treatment liquid drum 154. The treatment liquid application apparatus 156 includes a treatment liquid vessel in which treatment liquid is stored, an anilox roller which is partially immersed in the treatment liquid in the treatment liquid vessel, and a rubber roller which is pressed against the anilox roller and the recording medium 124 on the treatment liquid drum 154 so as to transfer a dosed amount of the treatment liquid to the recording medium 124. According to this treatment liquid application apparatus 156, it is possible to apply the treatment liquid to the recording medium 124 while dosing the amount of the treatment liquid.

In the present embodiment, a composition is described which uses a roller-based application method, but the method is not limited to this, and it is also possible to employ various other methods, such as a spray method, an inkjet method, or the like.

The recording medium 124 onto which the treatment liquid has been deposited by the treatment liquid deposition unit 114 is transferred from the treatment liquid drum 154 to the image formation drum 170 of the image formation unit 116 via the intermediate conveyance unit 126.

Image Formation Unit

The image formation unit 116 includes an image formation drum 170, a paper pressing roller 174, and inkjet heads 172M, 172K, 172C and 172Y Similarly to the treatment liquid drum 154, the image formation drum 170 has hook-shaped holding devices (grippers) 171 on the outer circumferential surface of the drum. The recording medium 124 held on the image formation drum 170 is conveyed with the recording surface thereof facing to the outer side, and the ink is deposited onto this recording surface from the inkjet heads 172M, 172K, 172C and 172Y.

The inkjet heads 172M, 172K, 172C and 172Y are respectively full-line type inkjet recording heads (inkjet heads) having a length corresponding to the maximum width of the image forming region on the recording medium 124, and a nozzle row of nozzles for ejecting ink arranged throughout the whole width of the image forming region is formed in the ink ejection surface of each head. The inkjet heads 172M, 172K, 172Y and 172Y are each disposed so as to extend in a direction perpendicular to the conveyance direction of the recording medium 124 (the direction of rotation of the image formation drum 170).

When droplets of the corresponding colored ink are ejected from each of the inkjet to heads 172M, 172K, 172C and 172Y toward the recording surface of the recording medium 124 which is held tightly on the image formation drum 170, the ink makes contact with the treatment liquid which has previously been deposited onto the recording surface by the treatment liquid deposition unit 114, the coloring material (pigment) dispersed in the ink is aggregated, and a coloring material aggregate is thereby formed. By this means, flowing of coloring material, and the like, on the recording medium 124 is prevented and an image is formed on the recording surface of the recording medium 124.

Although a configuration with the four standard colors of C, M, Y and K is described in the present embodiment, the combinations of the ink colors and the number of colors are not limited to these. Light inks, dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

The recording medium 124 onto which an image has been formed in the image formation unit 116 is transferred from the image formation drum 170 to the drying drum 176 of the drying unit 118 via the intermediate conveyance unit 128.

Drying Unit

The drying unit 118 is a mechanism which evaporates the water content contained in the solvent which has been separated by the action of aggregating the coloring material, and as shown in FIG. 22, includes a drying drum 176 and a solvent drying apparatus 178.

Similarly to the treatment liquid drum 154, the drying drum 176 has hook-shaped holding devices (grippers) 177 provided on the outer circumferential surface of the drum, in such a manner that the leading end of the recording medium 124 can be held by each of the holding device 177.

The solvent drying apparatus 178 is disposed in a position opposing the outer circumferential surface of the drying drum 176, and is constituted by a plurality of halogen heaters 180 and hot air spraying nozzles 182 disposed between the halogen heaters 180.

It is possible to achieve various drying conditions, by suitably adjusting the temperature and air flow volume of the hot air flow which is blown from the hot air flow spraying nozzles 182 toward the recording medium 124, and the temperatures of the respective halogen heaters 180.

Furthermore, the surface temperature of the drying drum 176 is set to 50° C. or above.

By performing heating from the rear surface of the recording medium 124, drying is promoted and breaking of the image during fixing can be prevented. There are no particular restrictions on the upper limit of the surface temperature of the drying drum 176, but from the viewpoint of the safety of maintenance operations such as cleaning the ink adhering to the surface of the drying drum 176 (preventing burns due to high temperature), desirably, the surface temperature of the drying drum 176 is equal to or lower than 75° C. (and more desirably, equal to or lower than 60° C.).

By holding the recording medium 124 in such a manner that the recording surface thereof is facing outwards on the outer circumferential surface of the drying drum 176 (in other words, in a state where the recording surface of the recording medium 124 is curved in a convex shape), and performing drying while conveying the recording medium in rotation, it is possible to prevent the occurrence of wrinkles or floating up of the recording medium 124, and therefore drying non-uniformities caused by these phenomena can be prevented reliably.

The recording medium 124 on which a drying process has been carried out in the drying unit 118 is transferred from the drying drum 176 to the fixing drum 184 of the fixing unit 120 via the intermediate conveyance unit 130.

Fixing Unit

The fixing unit 120 is constituted by a fixing drum 184, a halogen heater 186, a fixing roller 188 and an in-line sensor 190. Similarly to the treatment liquid drum 154, the fixing drum 184 has hook-shaped holding devices (grippers) 185 provided on the outer circumferential surface of the drum, in such a manner that the leading end of the recording medium 124 can be held by a holding device 185.

By means of the rotation of the fixing drum 184, the recording medium 124 is conveyed with the recording surface facing to the outer side, and preliminary heating by the halogen heater 186, a fixing process by the fixing roller 188 and inspection by the in-line sensor 190 are carried out in respect of the recording surface.

The halogen heater 186 is controlled to a prescribed temperature (for example, 180° C.). By this means, preliminary heating by the recording medium 124 is carried out.

The fixing roller 188 is a roller member for applying heat and pressure to the dried ink so as to melt self-dispersing polymer micro-particles contained in the ink and thereby causing the ink to form a film, and is composed so as to heat and pressurize the recording medium 124. More specifically, the fixing roller 188 is disposed so as to press against the to fixing drum 184, so as to serve as a nip roller between the fixing drum 184. By this means, the recording medium 124 is sandwiched between the fixing roller 188 and the fixing drum 184 and is nipped with a prescribed nip pressure (for example, 0.15 MPa), whereby a fixing process is carried out.

Furthermore, the fixing roller 188 is constituted by a heated roller in which a halogen lamp is provided inside a metal pipe of aluminum, or the like, having good thermal conductivity, and is controlled to a prescribed temperature (for example, 60° C. to 80° C.). By heating the recording medium 124 by means of this heating roller, thermal energy equal to or greater than the Tg temperature (glass transition temperature) of the latex contained in the ink is applied and the latex particles are thereby caused to melt. By this means, fixing is performed by pressing the latex particles into the undulations in the recording medium 124, as well as leveling the undulations in the image surface and obtaining a glossy finish.

In the embodiment shown in FIG. 22, only one fixing roller 188 is provided, but it is also possible to provide fixing rollers in a plurality of stages, in accordance with the thickness of the image layer and the Tg characteristics of the latex particles.

On the other hand, the in-line sensor 190 is a measurement device for measuring a test pattern (check pattern), the amount of moisture, the surface temperature, the glossiness, and the like, of the image fixed on the recording medium 124. A CCD line sensor, or the like, may be employed for the in-line sensor 190.

According to the fixing unit 120 having the composition described above, the latex particles in the thin image layer formed by the drying unit 118 are heated, pressurized and melted by the fixing roller 188, and hence the image layer can be fixed to the recording medium 124. Furthermore, the surface temperature of the fixing drum 184 is set to 50° C. or above. Drying is promoted by heating the recording medium 124 held on the outer circumferential surface of the fixing drum 184 from the rear surface, and therefore breaking of the image during fixing can be prevented, and furthermore, the strength of the image can be increased by the effects of the increased temperature of the image.

Instead of an ink which includes a high-boiling-point solvent and polymer micro-particles (thermoplastic resin particles), it is also possible to include a monomer which can be polymerized and cured by exposure to UV light. In this case, the inkjet recording apparatus 100 comprises a UV exposure unit for exposing the ink on the recording medium 124 to UV light, instead of a heat and pressure fixing unit (fixing roller 188) based on a heat to roller. In this way, if using an ink containing an active light-curable resin, such as an ultraviolet-curable resin, a device which radiates the active light, such as a UV lamp or an ultraviolet LD (laser diode) array, is provided instead of the fixing roller 188 for heat fixing.

Paper Output Unit

As shown in FIG. 22, a paper output unit 122 is provided subsequently to the fixing unit 120. The paper output unit 122 includes an output tray 192. A transfer drum 194, a conveyance belt 196 and a tensioning roller 198 are provided between the output tray 192 and the fixing drum 184 of the fixing unit 120 so as to oppose and make contact with same. The recording medium 124 is sent to the conveyance belt 196 by the transfer drum 194 and output to the output tray 192. The details of the paper conveyance mechanism including the conveyance belt 196 are not illustrated, but the leading end portion of a recording medium 124 after printing is held by a gripper on a bar (not illustrated) which spans between endless conveyance belts 196, and the recording medium is conveyed to above the output tray 192 due to the rotation of the conveyance belts 196.

The seasoning apparatus 10 (or 40, 50, etc.) described above is used as this output tray 192, and this apparatus functions as a loading table on which the paper sheets after printing (printed objects) are loaded, and functions as a seasoning apparatus. For example, when 100 sheets (a prescribed number of sheets) have been collected on the tray, a partitioning plate (corresponding to the ceiling plate 28) is introduced automatically, and then seasoning is carried out simultaneously in a lump on the stack of 100 sheets of paper situated below the partitioning plate.

Furthermore, although not shown in FIG. 22, the inkjet recording apparatus 100 according to the present embodiment includes, in addition to the composition described above, an ink storing and loading unit which supplies ink to the inkjet heads 172M, 172K, 172C and 172Y, and a device which supplies treatment liquid to the treatment liquid deposition unit 114, a head maintenance unit which carries out cleaning (nozzle surface wiping, purging, nozzle suctioning, and the like) of the inkjet heads 172M, 172K, 172C and 172Y, a position determination sensor which determines the position of the recording medium 124 in the paper conveyance path, and a temperature sensor which determines the temperature of the respective units of the apparatus, and the like.

Adaptation to Double-Side Printing

When carrying out double-side printing, in the inkjet recording apparatus 100 shown to in FIG. 22, seasoning is carried out for a prescribed period of time by the seasoning apparatus 10, after printing on one surface (the front surface) of the paper. The stack of paper which has undergone a seasoning process is then returned to the paper supply unit 112, and rear surface printing is carried out.

By this means, it is possible to achieve satisfactory double-side printing in a short period of time, without the occurrence of front/rear registration errors, and the like.

Furthermore, in the inkjet recording apparatus 100 shown in FIG. 22, it is also possible to adopt a composition in which a plurality of seasoning apparatuses 10 are provided for use in the output tray 192 and each of the seasoning apparatuses 10 can be moved between the paper output section 122 and the paper supply unit 112.

For example, it is possible to employ a composition in which the seasoning apparatuses 10 can travel by being provided with casters, and it is also possible to adopt a composition where the seasoning apparatuses travel on rails.

While a first seasoning apparatus is seasoning a stack of printed matters, another (second) seasoning apparatus is set in the paper output section 122 and receives printed matters which are newly printed and output. The stack of paper which has completed seasoning by the first seasoning apparatus is supplied to the paper supply unit 112.

When a prescribed number of printed matters have been stacked in the second seasoning apparatus, the second seasoning apparatus is withdrawn from the paper supply unit 122 and starts a seasoning operation. A third seasoning apparatus or the first seasoning apparatus which has become empty is set in the paper supply unit 122 and printing is continued. By composing the system by using a plurality of seasoning apparatuses in rotation in this way, it is possible to achieve automated operation, as well as being able to produce a large number of printed matters with good efficiency.

Ink

The ink used in the present embodiment is an aqueous ink including water as a solvent; for example, the ink is an aqueous pigment-based ink containing solvent-insoluble materials such as a pigment which is a coloring material (colorant) and polymer micro-particles, and the like.

Desirably, the density of the solvent-insoluble material is equal to or greater than 1 wt % and equal to or less than 20 wt %, taking account of the fact that the suitable viscosity for ejection is 20 mPa·s or lower. More desirably, the density of the pigment is 4 wt % or above, to in order to obtain good optical density in the image.

Desirably, the surface tension of the ink is equal to or greater than 20 mN/m and equal to or less than 40 mN/m, taking account of ejection stability.

The coloring material used in the ink may be pigment particles or a combination of dye and pigment. From the viewpoint of the aggregating properties upon contact with the treatment liquid, a pigment which is in a dispersed state in the ink is desirable, since such a pigment aggregates more effectively. Of pigments, it is particularly desirable to use a pigment which is dispersed by a dispersant, a self-dispersing pigment, a pigment in which the surfaces of the pigment particles are covered with a resin (microcapsule pigment), or a polymer grafted pigment. Furthermore, from the viewpoint of the aggregating properties of the pigment, a more desirable mode is one where the pigment is modified with a carboxyl group having a low degree of dissociation.

Desirably, polymer particles which do not contain a colorant are added to the colored ink liquid used in the present embodiment, as a component which reacts with the treatment liquid. The polymer micro-particles enhance the aggregating action and viscosity increasing action of the ink upon reaction with the treatment liquid, and thereby make it possible to improve the image quality. In particular, it is possible to obtain an ink having high stability by including anionic polymer micro-particles in the ink.

By using polymer micro-particles which produce a viscosity increasing action and aggregating action upon reaction with the treatment liquid, it is possible to improve image quality, while at the same time, depending on the type of polymer micro-particles used, beneficial effects are obtained in further improving the abrasion-resistant properties, weatherproofing properties and waterproofing properties of the image due to the polymer micro-particles forming a coating on the recording medium.

The method of dispersing the polymer in the ink is not limited to an emulsion, and it may be present in the state of a solution or a colloidal dispersion.

The polymer micro-particles may be dispersed by using an emulsifier, or without using an emulsifier. For the emulsifier, generally, a surfactant of low molecular weight is used, but it is also possible to use a surfactant of high molecular weight as the emulsifier. It is also desirable to use capsule type polymer micro-particles in which the outer shell is made of acrylic acid, methacrylic acid, or the like (namely, core—shell type polymer micro-particles which have different compositions between in the central portion and in the outer edge to portion).

Possible examples of a resin component which is added to the ink in the form of polymer micro-particles include: an acrylic resin, a vinyl acetate resin, a styrene-butadiene resin, a vinyl chloride resin, an acryl-styrene resin, a butadiene resin, a styrene resin, and the like.

A material having a carboxylic acid group with a low degree of dissociation is more desirable, from the viewpoint of imparting fast aggregating properties to the polymer micro-particles. Since the carboxylic acid group is liable to be affected by change in the pH, the state of dispersion is liable to change, and hence the aggregating properties are high.

The change in the state of dispersion of the polymer micro-particles caused by change in the pH can be adjusted by means of the content ratio of the constituent components of the polymer micro-particles which contain a carboxylic acid group, such as ester acrylate, or the like, and it can also be adjusted by means of an anionic surfactant which is used as a dispersant.

Desirably, the resin component of the polymer micro-particles is a polymer which has both a hydrophilic part and a hydrophobic part. By incorporating a hydrophobic part, the hydrophobic part is oriented toward to the inner side of the polymer micro-particle, and the hydrophilic part is oriented efficiently toward the outer side, thereby having the effect of further increasing the change in the dispersion state caused by change in the pH of the liquid. Therefore, aggregation can be performed more efficiently.

Moreover, two or more types of polymer micro-particles may be blended in combination in the ink.

It is possible to use an organic base or an inorganic alkaline base as a neutralizer serving as a pH adjuster which is added to the ink according to the present embodiment. Desirably, such a pH adjuster is added so as adjust the ink to a pH of 6 to 10, in order to improve the storage stability of the inkjet ink.

The ink according to the present embodiment desirably contains a water-soluble organic solvent in order to prevent blockages of the nozzles of the inkjet head due to drying. A water-soluble organic solvent of this kind includes a moistening agent or a penetrating agent.

Similarly to the case of the treatment liquid, possible examples of the water-soluble organic solvent are: polyvalent alcohols, polyvalent alcohol derivatives, nitrogenous solvents, to alcohols, sulfurous solvents, and the like.

Additionally, according to requirements, it is also possible to add a surfactant, a pH buffering agent, an antioxidant, an anti-rusting agent, a viscosity adjuster, a conducting agent, an ultraviolet absorber, or the like.

Furthermore, it is also possible to include thermoplastic resin micro-particles in the ink. By including thermoplastic resin, film formation progresses during the heating step and the image strength can be improved. If a thermoplastic resin is included, it is more beneficial to carry out a fixing step for heating and pressurizing the image, in addition to a heating process during drying.

Moreover, by including an ultraviolet-curable monomer in the ink, after the water has been evaporated off sufficiently in the drying unit, ultraviolet light is irradiated onto the image by a fixing unit comprising an ultraviolet irradiation lamp, or the like, thereby curing and polymerizing the ultraviolet-curable monomer and making it possible to improve the strength of the image.

Treatment Liquid

A desirable treatment liquid (aggregating treatment liquid) for used in implementing embodiments of the present invention is a treatment liquid which alters the pH of the ink so as to cause aggregation of the pigment and polymer micro-particles contained in the ink, thus producing an aggregate material.

Desirably, a component of the treatment liquid is selected from: polyacrylic acid, acetic acid, glycol acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives of these compounds, or salts of these, or the like.

A desirable example of the treatment liquid is a treatment liquid to which a multivalent metal salt or polyallylamine has been added. For these compounds, single type (one type) may be used, or a combination of two or more of these compounds may be used.

From the viewpoint of the pH aggregating performance with respect to the ink, the treatment liquid desirably has a pH of 1 to 6, more desirably, a pH of 2 to 5, and especially desirably, a pH of 3 to 5.

Furthermore, from the viewpoint of preventing nozzle blockages in the inkjet head to due to drying, desirably, the treatment liquid also contains water or another additive-soluble organic solvent. The water or another additive-soluble organic solvent includes a moistening agent or a penetrating agent. These solvents can be used independently, or in plural fashion, together with water and the other additive.

It is also possible to include a resin component in the treatment liquid in order to improve the fixing characteristics, abrasive-resistant properties and weatherproofing. The resin component may be any resin which would not impair the ejection characteristics from a head if the treatment liquid is ejected in the form of droplets by an inkjet method, and which has stable storage characteristics, and it is possible freely to choose a water-soluble resin, resin emulsion, or the like.

Additionally, according to requirements, it is also possible to add a surfactant, a pH buffering agent, an antioxidant, an anti-rusting agent, a viscosity adjuster, a conducting agent, an ultraviolet absorber, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A printing paper seasoning apparatus comprising:

a loading table on which a plurality of sheets of printing paper are stacked and loaded;

a ceiling plate which is disposed above the loading table so as to oppose the loading table for covering over an upper side of a stack of the printing paper loaded on the loading table;

an air blowing device which blows air from a side face side into a paper accommodating region formed between the loading table and the ceiling plate which are arranged so as to oppose each other;

a side plate arranged in a side face portion of the paper accommodating region; and an exhaust section including openings formed in the side plate, wherein an opening ratio of the exhaust section varies in a vertical direction of the paper accommodating region in such a manner that the opening ratio on a lower side of the exhaust section is smaller than the opening ratio on an upper side of the exhaust section.

2. The printing paper seasoning apparatus as defined in claim 1, wherein the opening ratio of the exhaust section becomes smaller, in stepwise fashion or continuously, from an upper side toward a lower side of the paper accommodating region.

3. The printing paper seasoning apparatus as defined in claim 1, wherein a minimum value of the opening ratio on the lower side is 1/20 or more and 2/3 or less of a maximum value of the opening ratio on the upper side.

4. The printing paper seasoning apparatus as defined in claim 1, wherein the exhaust section is formed in, of the side plates which cover the side face portions of the paper accommodating region, the side plate where the air blowing device is not provided.

5. The printing paper seasoning apparatus as defined in claim 1, wherein a paper loading surface of the loading table and a paper restricting surface of the ceiling surface which opposes the paper loading surface have curvature in a direction perpendicular to an air blowing direction of the air blowing device.

6. The printing paper seasoning apparatus as defined in claim 1, wherein static pressure of the air blown from the air blowing device is 500 (Pa) or more.

7. The printing paper seasoning apparatus as defined in claim 1, wherein air volume vs. static pressure characteristics of the air blowing device encompass a point where required air flow volume $Q=M\times Wp\times 0.02$ ($m^3$/min) and required static pressure P=500 (Pa), where M (sheets) represents a maximum number of processed sheets which can be processed simultaneously in one lump by the seasoning apparatus and Wp (m) represents length of one edge of a breadthways direction of the paper viewed from an air blowing side of the air blowing device.

8. The printing paper seasoning apparatus as defined in claim 1, comprising at least one shelf plate and having composition in which the printing paper is accommodated by being divided into a plurality of stacks by a structure of a plurality of tiers divided by the at least one shelf plate.

9. An inkjet recording apparatus comprising the printing paper seasoning apparatus as defined in claim 1 installed in a paper output section.

10. A method of seasoning of printing paper, comprising the steps of:

loading a plurality of sheets of the printing paper onto a loading table;

covering over an upper side of a stack of the printing paper loaded on the loading table, with a ceiling plate; and blowing air by an air blowing device from a side face side into a paper accommodating region formed between the loading table and the ceiling plate which are arranged to oppose each other, so as to supply the air between sheets of the printing paper in the stack of the printing paper, wherein openings for expelling air are formed on a side plate arranged in a side face portion of the paper accommodating region, an opening ratio of an exhaust section including the openings is varied in a vertical direction of the paper accommodating region in such manner that the opening ratio on a lower side is made smaller than the opening ratio on an upper side, and the air blown by the air blowing device in a state where pressure of air flowing on a lower side of the paper accommodating region is higher than pressure of air flowing on an upper side of the paper accommodating region.

* * * * *